US007597315B2

(12) United States Patent
Yamamoto et al.

(10) Patent No.: US 7,597,315 B2
(45) Date of Patent: Oct. 6, 2009

(54) SHEET PACKAGE INCLUDING SIDE PARTS FOR A PRINTER

(75) Inventors: Minoru Yamamoto, Nagoya (JP); Terumasa Hoshino, Nagoya (JP); Motoaki Yamanashi, Konan (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 251 days.

(21) Appl. No.: 10/522,855

(22) PCT Filed: Jul. 25, 2003

(86) PCT No.: PCT/JP03/09478

§ 371 (c)(1),
(2), (4) Date: Jul. 1, 2005

(87) PCT Pub. No.: WO2004/011355

PCT Pub. Date: Feb. 5, 2004

(65) Prior Publication Data

US 2006/0012110 A1 Jan. 19, 2006

(30) Foreign Application Priority Data

Jul. 29, 2002 (JP) ..... 2002-219373

(51) Int. Cl.
*B65H 1/00* (2006.01)

(52) U.S. Cl. ..... 271/145; 221/197; 221/287; 206/494; 206/449

(58) Field of Classification Search ..... 271/145; 358/1.12, 498, 296; 396/511; 406/449, 455
See application file for complete search history.

(56) References Cited

U.S. PATENT DOCUMENTS

| | | | | | |
|---|---|---|---|---|---|
| 3,727,823 | A * | 4/1973 | Sullivan | ..... | 206/449 |
| 3,767,188 | A * | 10/1973 | Rosenberg et al. | ..... | 271/145 |
| 4,494,746 | A * | 1/1985 | Moser | ..... | 271/164 |
| 5,163,670 | A * | 11/1992 | Sellers et al. | ..... | 271/157 |
| 5,687,965 | A * | 11/1997 | Matsuda et al. | ..... | 271/241 |
| 6,179,499 | B1 * | 1/2001 | Beretta et al. | ..... | 400/605 |
| 6,217,019 | B1 * | 4/2001 | Ishiduka et al. | ..... | 271/147 |
| 6,227,732 | B1 * | 5/2001 | Higuchi et al. | ..... | 400/624 |
| 6,318,918 | B1 * | 11/2001 | Sasaki et al. | ..... | 400/624 |
| 6,460,845 | B1 * | 10/2002 | Sasaki et al. | ..... | 271/121 |

(Continued)

FOREIGN PATENT DOCUMENTS

EP 0 768 566 A2 4/1997

(Continued)

*Primary Examiner*—Patrick H Mackey
*Assistant Examiner*—Gerald W McClain
(74) *Attorney, Agent, or Firm*—Oliff & Berridge, PLC

(57) ABSTRACT

A sheet package to be set in a sheet storage unit of a printer includes a stack of sheets and a package member covering the stack of sheets. The sheets are supplied from the sheet package to the printer along a sheet feed direction. The package member has a side part being in parallel with the sheet feed direction and having an edge at its front in the sheet feed direction. The side part is structured so that a projecting part of the sheet storage unit secures the position of the package member by contacting the front edge of the side part and the side edge of the stack of sheets when the package member is placed in the sheet storage unit relative to the sheet feed direction.

1 Claim, 22 Drawing Sheets

U.S. PATENT DOCUMENTS

| | | | | |
|---|---|---|---|---|
| 6,546,210 | B1 * | 4/2003 | Nakamura | 399/12 |
| 6,793,425 | B2 * | 9/2004 | Yoshikawa et al. | 400/624 |
| 2001/0011795 | A1 * | 8/2001 | Ohtsuka et al. | 271/145 |
| 2002/0056961 | A1 * | 5/2002 | Sasaki et al. | 271/145 |
| 2003/0006546 | A1 * | 1/2003 | Toda et al. | |
| 2003/0164317 | A1 * | 9/2003 | Fujiwara | 206/425 |
| 2003/0234486 | A1 * | 12/2003 | Taku | 271/264 |
| 2004/0089671 | A1 * | 5/2004 | Miller | 221/305 |
| 2005/0242492 | A1 * | 11/2005 | Yang | 271/171 |

FOREIGN PATENT DOCUMENTS

| | | | | |
|---|---|---|---|---|
| EP | 0 941 862 | A2 | | 9/1999 |
| GB | 1 599 492 | | | 10/1981 |
| JP | 48104334 | A | * | 12/1973 |
| JP | U-48-104334 | | | 12/1973 |
| JP | 0188631 | | * | 6/1989 |
| JP | U-01-088631 | | | 6/1989 |
| JP | 03297737 | A | * | 12/1991 |
| JP | 04317929 | A | * | 11/1992 |
| JP | A-11-240629 | | | 9/1999 |
| JP | A-11-334899 | | | 12/1999 |
| JP | 2000168966 | A | * | 6/2000 |
| JP | A-2001-080755 | | | 3/2001 |
| WO | WO 9947362 | A1 | * | 9/1999 |

* cited by examiner

SHEET PACKAGE MANUFACTURING PROCESS : 1

SHEET PACKAGE MANUFACTURING PROCESS : 2

SHEET PACKAGE MANUFACTURING PROCESS : 3

SHEET PACKAGE MANUFACTURING PROCESS : 4

SHEET PACKAGE MANUFACTURING PROCESS : 5

SETTING SHEET PACKAGE IN PRINTER : 1

SETTING SHEET PACKAGE IN PRINTER : 2

SETTING SHEET PACKAGE IN PRINTER : 3

SETTING SHEET PACKAGE IN PRINTER : 4

SETTING SHEET PACKAGE IN PRINTER : 4

SETTING SHEET PACKAGE IN PRINTER : 5

HOW TO CLOSE SHEET PACKAGE : 1

HOW TO CLOSE SHEET PACKAGE : 2

EXAMPLE 1 OF RELATIVE DISPLACEMENT

EXAMPLE 2 OF RELATIVE DISPLACEMENT

SHEET PACKAGE INCLUDING SIDE PARTS FOR A PRINTER

TECHNICAL FIELD

The present invention relates to a sheet package including a stack of sheets covered with a package member, allowing the sheets to be set in a printer together with the package member.

BACKGROUND OF THE INVENTION

Sheet packages, packages covering a stack of printer sheets with a package member, have been well known today. A sheet package is opened by a user purchasing the package and then set in a printer. Such sheet packages allow users to handle numbers of sheets in a mass, package by package, providing improved usability of sheets. The sheet packages, covering and protecting the sheets with a package member, are especially useful for heat-sensitive sheets which are susceptible to light and heat.

In recent years, with the ongoing miniaturization of personal computers and prevalence of PDAs (Personal Digital Assistants), printers that are small-sized and portable are in great and increasing demand. With such small-sized printers, especially with printers supporting small sheets of the post card size or less, the handling of sheets is not simple and easy and thus the use of sheet packages (covering a stack of sheets with a package member) is desired.

However, in such a small-sized printer, a sheet package loaded in the printer can shift from its normal position due to vibration during carriage, etc., hampering normal printing. Therefore, a sheet package not easily undergoing the displacement in the printer has been sought after.

DISCLOSURE OF THE INVENTION

It is therefore the primary object of the present invention to provide a sheet package, a package member and a printer system meeting the above requirement.

In accordance with an aspect of the present invention, there is provided a sheet package to be set in a sheet storage unit of a printer for supplying the printer with sheets. The sheet package comprises a stack of sheets and a package member covering the stack of sheets. When the sheet package is set in the sheet storage unit of the printer, the sheets are supplied from the sheet package to the printer along a sheet feed direction. The package member has a side part spreading in parallel with the sheet feed direction and having an edge at its front in the sheet feed direction. The side part places the package member at a proper position in the sheet storage unit of the printer in regard to the sheet feed direction by letting the edge make contact with a projecting part formed in the sheet storage unit. Therefore, the sheet package does not easily undergo the displacement in the sheet storage unit of the printer.

In accordance with another aspect of the present invention, there is provided a package member covering a stack of sheets, for being set in a sheet storage unit of a printer together with the sheets and supplying the sheets to the printer along a sheet feed direction. The package member has a side part spreading in parallel with the sheet feed direction and having an edge at its front in the sheet feed direction. The side part places the package member at a proper position in the sheet storage unit of the printer in regard to the sheet feed direction by letting the edge make contact with a projecting part formed in the sheet storage unit. Therefore, the package member does not easily undergo the displacement in the sheet storage unit of the printer.

In accordance with still another aspect of the present invention, there is provided a printer system comprising a printer and a sheet package supplying the printer with sheets along a sheet feed direction. The printer of the printer system includes a sheet storage unit for storing the sheet package. The sheet package of the printer system includes a stack of sheets and a package member covering the stack of sheets. The package member has a side part spreading in parallel with the sheet feed direction and having an edge at its front in the sheet feed direction. The side part places the package member at a proper position in the sheet storage unit of the printer in regard to the sheet feed direction by letting the edge make contact with a projecting part formed in the sheet storage unit. Therefore, the sheet package does not easily undergo the displacement in the sheet storage unit of the printer.

BEST MODE FOR CARRYING OUT THE INVENTION

In the following, a description will be given in detail of a preferred embodiment in accordance with the present invention.

[Composition of Printer]

Figure 1:
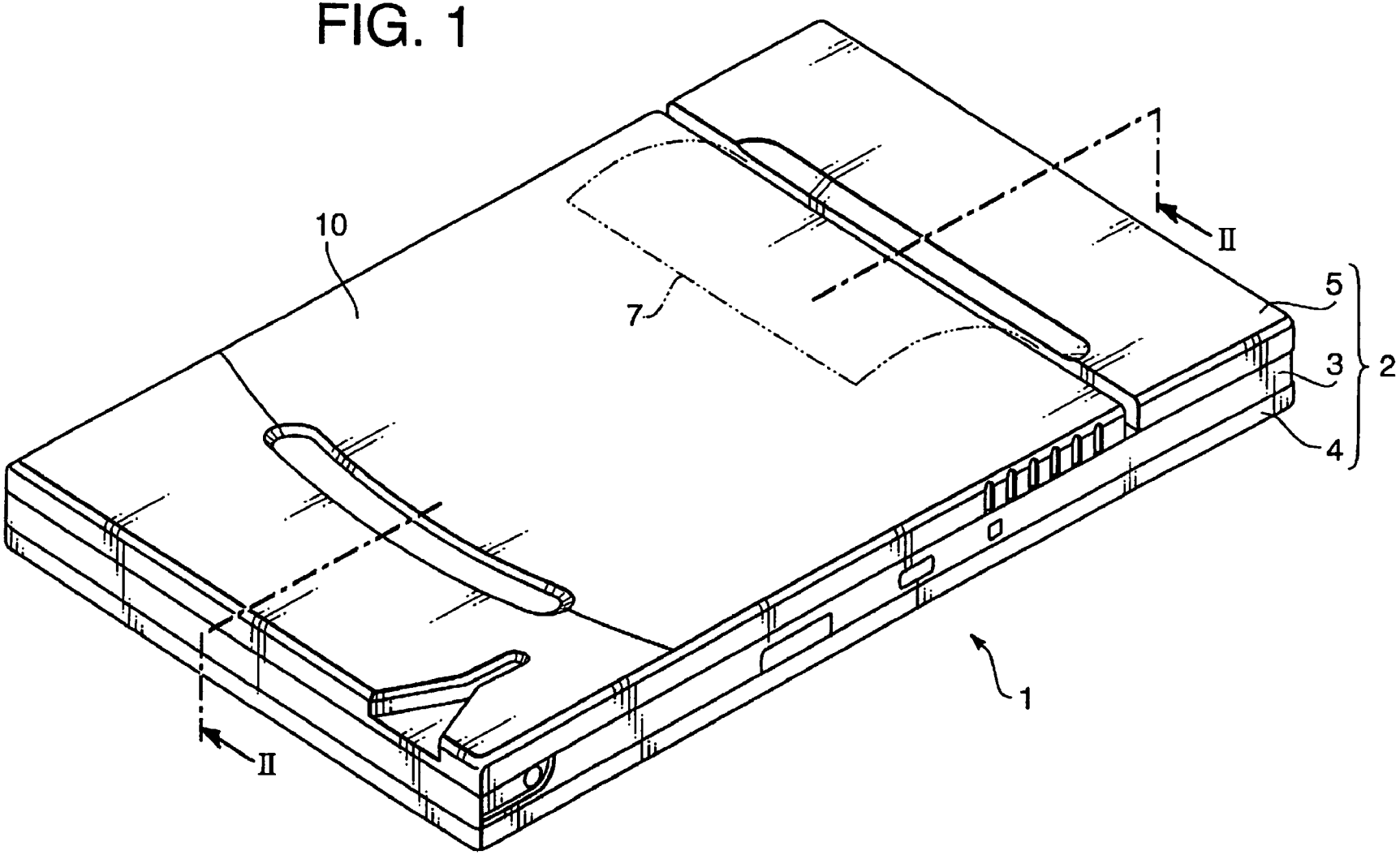
FIGS. 1 and 2 are perspective views of a printer in which a sheet package in accordance with an embodiment of the present invention is set.
Figure 2:
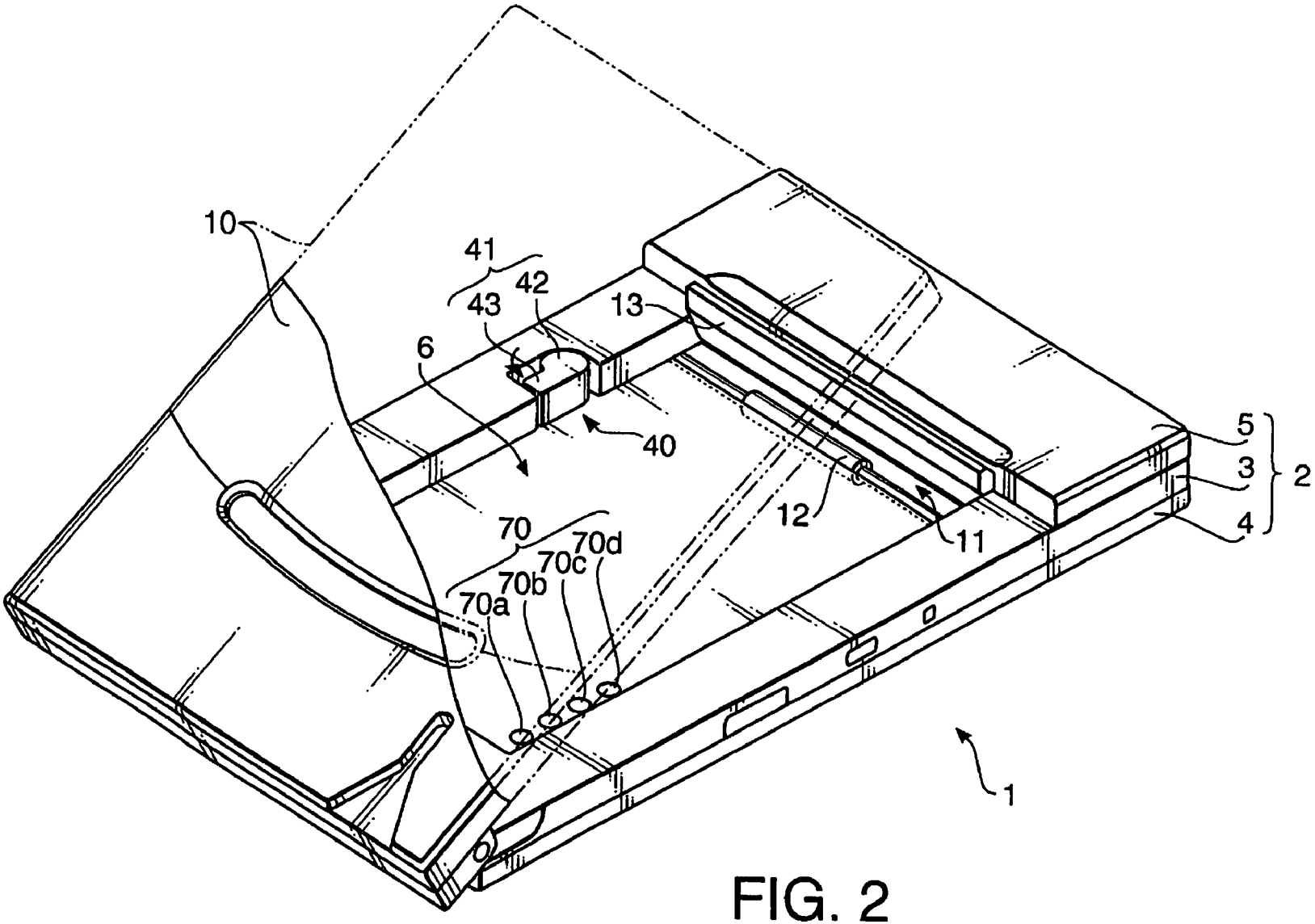
Figure 3:
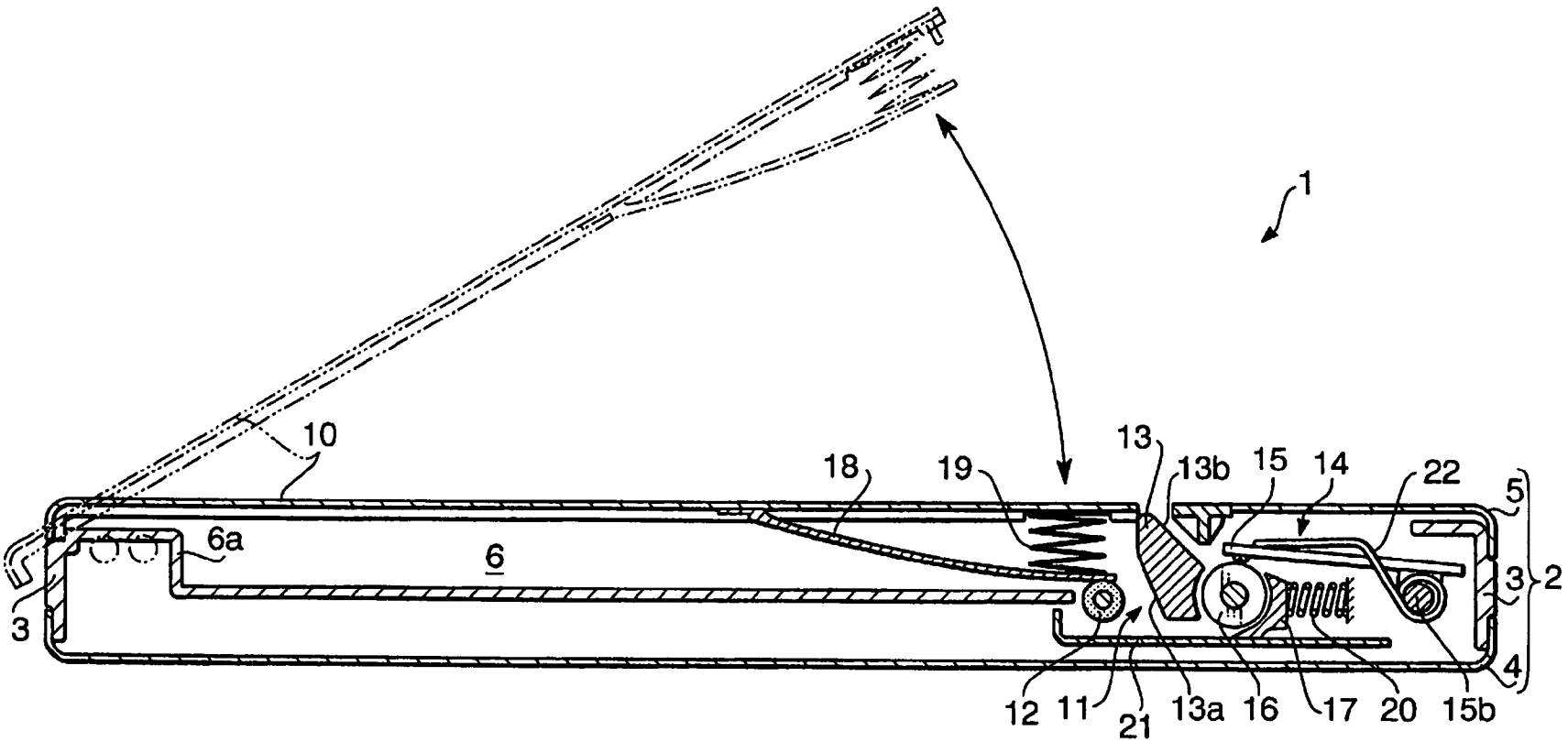
FIGS. 3 and 4 are cross-sectional views of the printer taken along the line II-II shown in FIG. 1.
Figure 4:
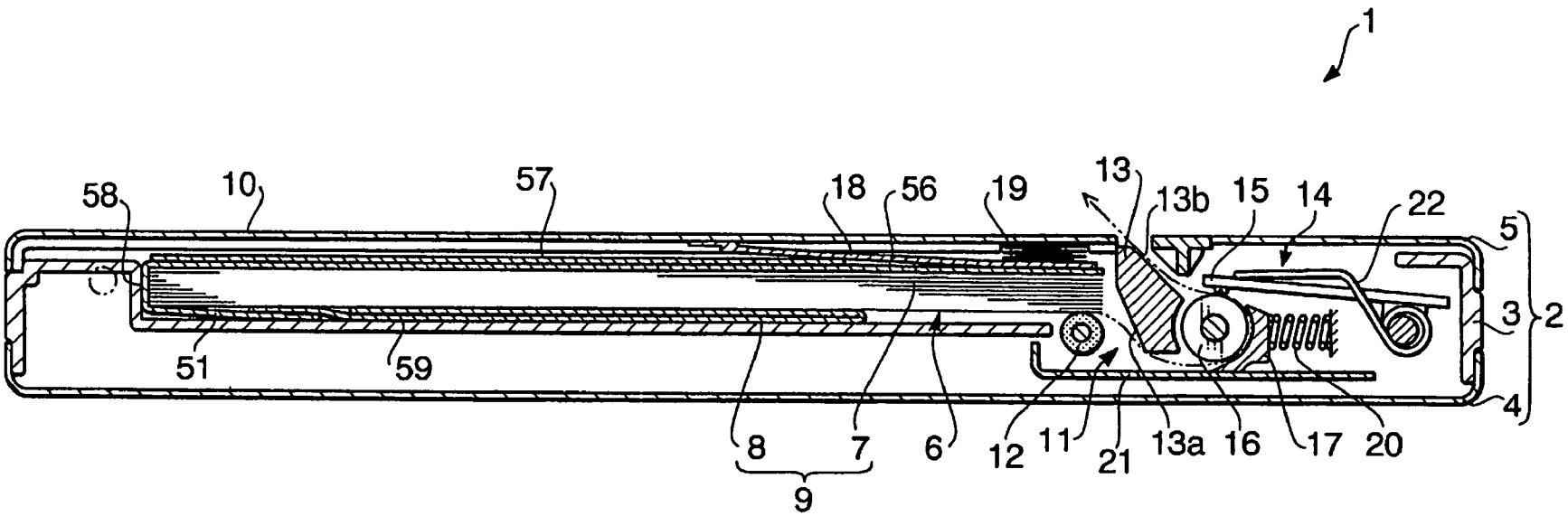

FIGS. 1 and 2 are perspective views of a printer (thermal recording device) 1. FIGS. 3 and 4 are cross-sectional views of the printer 1 taken along the line II-II shown in FIG. 1, in which FIG. 3 shows the printer 1 without sheets set therein and FIG. 4 shows the printer 1 with the sheets set therein. FIG.

5 is an enlarged sectional view showing a sheet separation unit and a print mechanism unit of the printer 1 shown in FIG. 1.

The printer 1 has a rectangular shape when seen from above and a size capable of accommodating sheets of A6-A7 sizes. The printer 1 is a compact printer with a thickness of approximately 2 cm or less.

As shown in FIG. 3, a body case 2 of the printer 1 includes a frame 3, a lower cover 4 covering the bottom of the frame 3, and an upper cover 5 covering part of the top of the frame 3.

In an upper part of the frame 3, a sheet storage unit (sheet supply unit) 6 is formed. The sheet storage unit 6 is provided to a part that is not covered with the upper cover 5. As shown in FIG. 4, the sheet storage unit 6 can store a sheet package 9. The sheet package 9 includes a package member 8 and a plurality of heat-sensitive sheets (print mediums, hereinafter referred to as "sheets") 7 stored in the package member 8. The sheets 7 are cut sheets of A6-A7 size.

The sheet storage unit 6 can be closed up with a lid 10. The lid 10 is rotatably attached to the body case 2 as indicated by two-dot chain lines in FIG. 3. The body case 2 is provided with a lock mechanism (unshown) for locking the lid 10 at its closed position (see FIG. 3).

At one end of the sheet storage unit 6 (at one end of the sheets 7 in its lengthwise direction), a sheet separation unit 11 is placed. The sheet separation unit 11 includes a pickup roller 12 and a separation block 13. Beneath the upper cover 5, a print mechanism 14 is placed. The print mechanism 14 includes a thermal head 15, a platen roller 16 and a paper guide 17.

As shown in FIG. 2, the sheet storage unit 6 is formed as a rectangular concavity capable of storing the sheet package 9.

On a side wall of the sheet storage unit 6 (on a wall part adjacent to the sheets 7 in their width direction), a concave part 40 is formed and a guide member 41 is placed in the concave part 40. The guide member 41 includes a base 42 which is rotatable around an unshown axis and an arm 43 which is formed integrally with the base 42.

The base 42 is provided with an unshown spring. The spring pushes the arm 43 in the direction of an arrow shown in FIG. 3 to let the arm 43 project into the inside of the sheet storage unit 6. When the sheet package 9 is stored in the sheet storage unit 6, the pushed arm 43 contacts the side face of the sheets 7 in the sheet package 9, by which the sheets 7 are pressed against the opposite side wall of the sheet storage unit 6 so as not to be skewed (fed obliquely).

At the bottom of the sheet storage unit 6, a reflective sensor unit 70 is provided. The reflective sensor unit 70 is placed in the vicinity of a corner at one end of the sheet storage unit 6 opposite to the sheet separation unit 11. The reflective sensor unit 70 includes four sensors 70*a*-70*d* arranged in a line. The sensors 70*a*-70*d* read an identification mark 71 (explained later) of the sheet package 9 by measuring reflectivity of light emitted toward the sheet package 9.

Next, the sheet separation unit 11 will be explained below.

Figure 5:
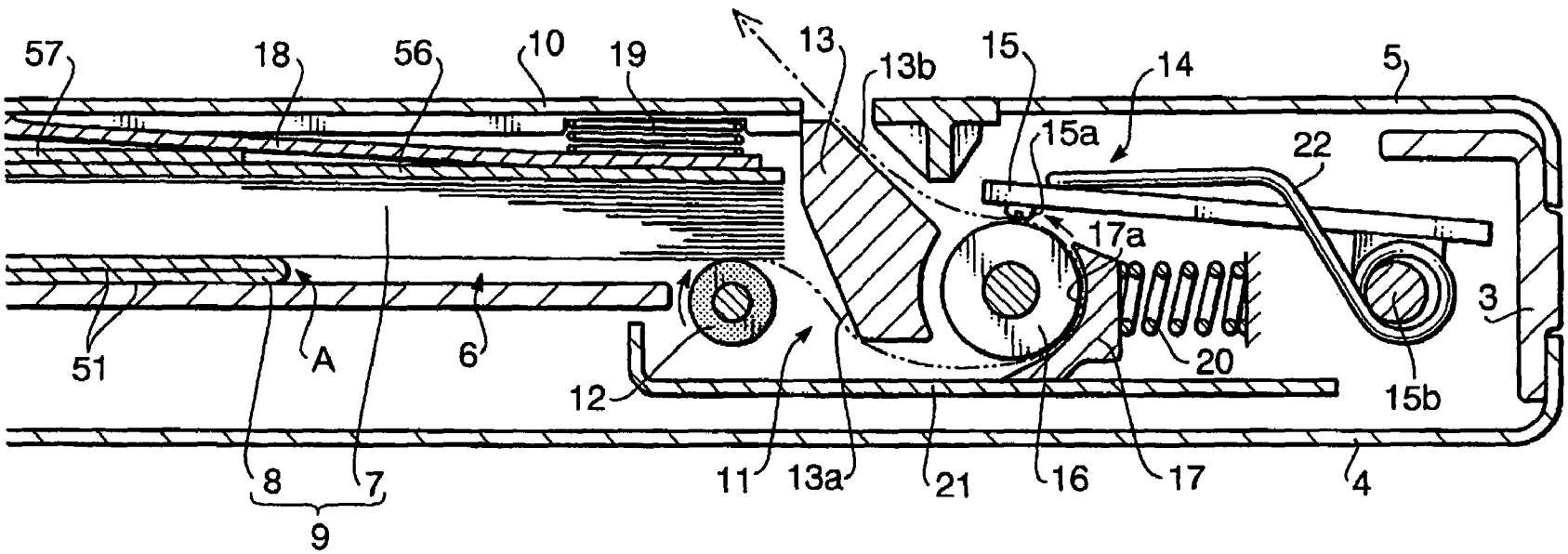
FIG. 5 is an enlarged sectional view showing a sheet separation unit and a print mechanism unit of the printer 1 shown in FIG. 1.

As shown in FIG. 5, at one end of the sheet storage unit 6 in the vicinity of the print mechanism unit 14, the pickup roller 12 and the separation block 13 are placed. On a surface of the lid 10 facing the sheet storage unit 6, a pressure plate 18 is supported rotatably. Between the pressure plate 18 and the lid 10, a spring 19 is placed, which constantly presses the pressure plate 18 downward (toward the pickup roller 12).

The sheet package 9 is loaded in the sheet storage unit 6 letting print surfaces of the stacked sheets 7 face downward (toward the pickup roller 12), with part of the lower surface of the lowermost one of the stacked sheets 7 being exposed from the package member 8. When the lid 10 is closed and locked, the pressure plate 18 pressed by the spring 19 presses a front part of the sheets 7 (at the front end in the sheet feed direction) via the package member 8 (tongue part 56) on the front part, by which the exposed part of the sheets 7 is pressed against the pickup roller 12 with appropriate force.

The separation block 13 is provided in the vicinity of the pickup roller 12. The separation block 13 has a guide surface 13*a* being tilted with respect to the sheet feed direction of the pickup roller 12.

According to the rotation of the pickup roller 12, the lowermost sheet 7 contacting the pickup roller 12 moves toward the separation block 13 and makes contact with the guide surface 13*a*. In case where another sheet 7 dragged by the lowermost sheet 7 also moves toward the separation block 13, the accompanying sheet 7 is separated from the lowermost sheet 7 at the guide surface 13*a* and only the lowermost sheet 7 is conveyed further.

Next, the print mechanism unit 14 will be explained below.

As shown in FIG. 5, the platen roller 16 is provided rotatably in the vicinity of the separation block 13. The paper guide 17 is placed close to the exterior surface of the platen roller 16.

The paper guide 17 is provided with a sliding surface 17*a* curving along the exterior surface of the platen roller 16. Between the paper guide 17 and the body case 2, a pressure coil spring 20 is provided. The pressure coil spring 20 pushes the sliding surface 17*a* toward the exterior surface of the platen roller 16.

The sheet 7 separated by the sheet separation unit 11 is fed by the pickup roller 12 and thereby passes through a gap between the bottom of the separation block 13 and a guide plate 21 for guiding the sheet 7 toward the platen roller 16.

The sheet 7 guided by the guide plate 21 is fed beneath the platen roller 16 into a gap between the platen roller 16 and the paper guide 17. The sheet 7 is then fed by the platen roller 16 to the top of the platen roller 16, by which the sheet 7 is turned over, letting its print surface face upward.

Above the platen roller 16, the thermal head 15 is placed. The thermal head 15 has a heating element unit 15*a* facing the platen roller 16. The thermal head 15 is provided to be rotatable around an axis 15*b*, by which the heating element unit 15*a* can contact and separate from the top of the platen roller 16. In case where the sheet 7 gets jammed between the platen roller 16 and the paper guide 17, removal of the jammed sheet can be facilitated by separating the thermal head 15 from the platen roller 16.

A spring 22 of a coil spring type is attached to the axis 15*b*, with its one end engaged with the thermal head 15. The spring 22 constantly pushes the thermal head 15 so as to press the heating element unit 15*a* against the top of the platen roller 16.

The heating element unit 15*a* of the thermal head 15 makes contact with the upper surface of the sheet 7 being fed by the platen roller 16 with its print surface facing upward. The printing is carried out at the position where the heating element unit 15*a* contacts the sheet 7.

The thermal head 15 is a printing head categorized as a line head, successively printing each line of an image, letters, etc. to be printed. The maximum printing width of the thermal head 15 is substantially equal to the width of the sheet 7.

By use of such a thermal head 15 as the printing head, consumable items like ink, ink ribbons, etc. becomes unnecessary and a mechanism for ink supply can be left out, by which the printer 1 can be designed compact in size.

As the heat-sensitive sheet, this embodiment employs a sheet of the so-called heat-coloring type, having a color layer (taking on a color when heated by the thermal head 15)

formed on a base layer. However, the type of the heat-sensitive sheet is not limited to the heat-coloring type. For example, a sheet having a perforation layer (perforated by heating) stacked on a base layer (heat-perforation type) can also be used. It is also possible to employ thermal-transfer sheets, etc. instead of the heat-sensitive sheets.

On the separation block 13, a sheet ejection guide surface 13*b*, being tilted relative to the sheet feed direction of the platen roller 16, is formed.

The sheet 7 after being printed on by the thermal head 15 is guided by the sheet ejection guide surface 13*b* and thereby ejected upward through a gap between the lid 10 and the upper cover 5 of the body case 2, as indicated by a two-dot chain line in FIG. 1.

[Composition of Sheet Package]

Next, the sheet package 9 will be explained below.

Figure 6:
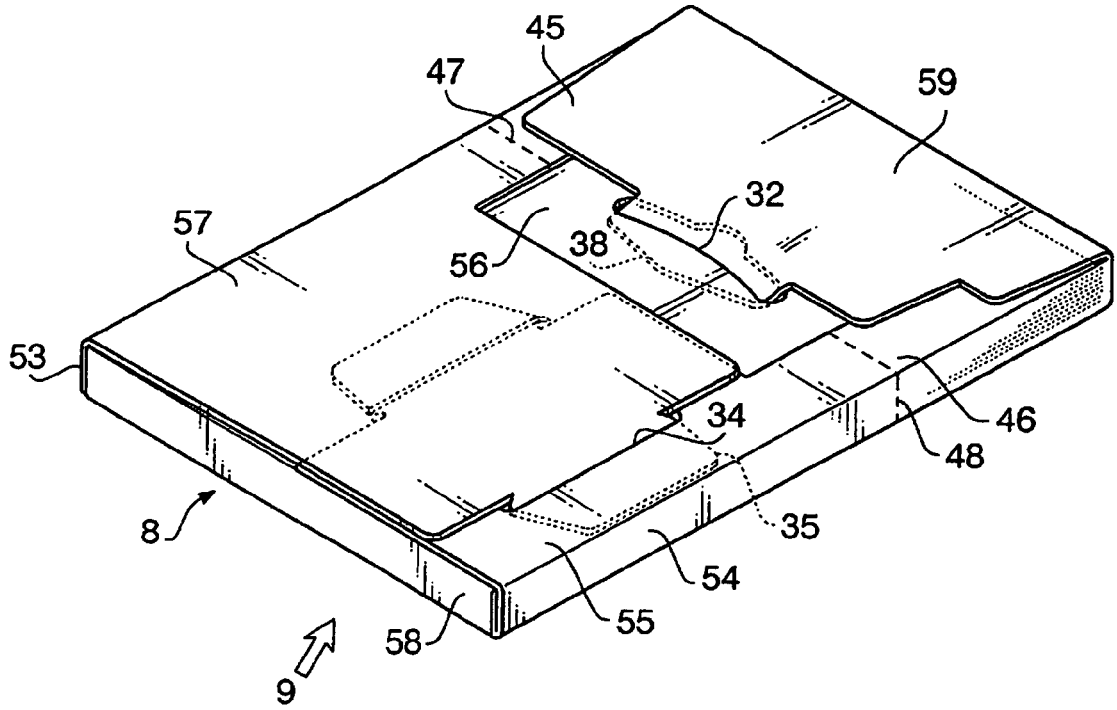
FIG. 6 is a perspective view of a sheet package in accordance with an embodiment of the present invention.
Figure 7:
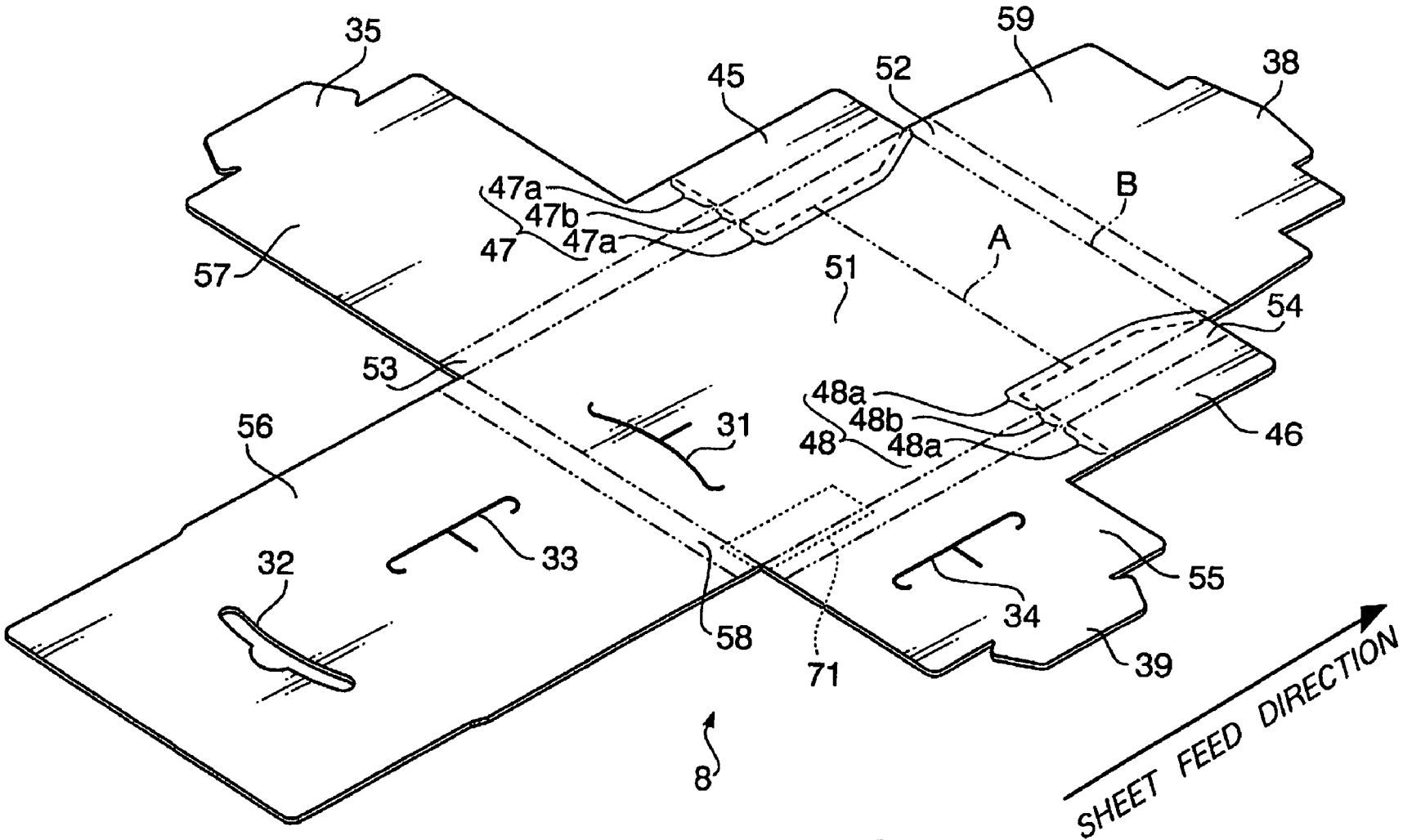
FIG. 7 is a developed view of a package member of the sheet package of FIG. 6.

FIG. 6 is a perspective view of the sheet package 9. FIG. 7 is a developed view of the package member 8. A manufacturing process of the sheet package 9 is shown in turn in FIGS. 8 through 12.

In the sheet package 9, a plurality of (e.g. 50) sheets (e.g. heat-sensitive sheets) 7 which have been stacked up are stored in the package member 8. The sheets 7 have been cut in a small size (e.g. A6-A7 size). The user purchases the sheet package 9 in the state shown in FIG. 6, exposes part of the sheets 7 from the package member 8 by a method which will be described later, and sets the sheet package 9 in the sheet storage unit 6 of the printer 1.

The package member 8 is formed by folding a plane cardboard material (sheet-like member) into a box-like shape. The cardboard material before being folded is shown in FIG. 7. The cardboard material includes a base 51 having almost the same (rectangular) shape as the sheet 7, a tongue part 56, a wrapping part 57, a tongue fixing part 55 and a flap part 59 which are formed around the base 51 integrally.

Specifically, at the rear end of the base 51 in the sheet feed direction, an end part 58 is formed continuously and the tongue part 56 is formed continuously to the end part 58.

On one side of the base 51 parallel to the sheet feed direction, a side part 53 is formed continuously and the wrapping part 57 is formed continuously to the side part 53.

On the other side of the base 51 parallel to the sheet feed direction, a side part 54 is formed continuously and the tongue fixing part 55 is formed continuously to the side part 54.

At the front end of the base 51 in the sheet feed direction, a top part 52 is formed continuously and the flap part 59 is formed continuously to the top part 52.

The end part 58, the side part 54, the side part 53 and the top part 52 cover the side faces of the stacked sheets 7 stored in the package member 8. The parts 58, 54, 53 and 52 extend from the base 51 by the same length.

On the base 51, the identification mark 71 is formed by a well-known method like printing so that the identification mark 71 will be situated in a reading zone of the reflective sensor unit 70 when the sheet package 9 is set in the sheet storage unit 6 of the printer 1. Specifically, the identification mark 71 is formed in the vicinity of a corner of the base 51 at its rear end in the sheet feed direction.

The boundaries of each part (51-59) of the package member 8 (indicated by two-dot chain lines in FIG. 7) are creased. The package member 8 can be shaped into a box easily by folding it along the creases.

A cut 31 to be used for setting the sheet package 9 in the printer 1 (setting cut 31) is made into the base 51. In the tongue part 56, a cut 32 for fixing the flap part 59 (flap fixing cut 32) and a cut 33 for fixing the tongue part 56 (tongue fixing cut 33) are formed. Further, in the tongue fixing part 55, a cut 34 for fixing the wrapping part 57 (wrap fixing cut 34) is formed. Into each cut, a corresponding part of the package member 8 can be inserted. The details will be explained later.

[Manufacturing Process of Sheet Package]

The sheet package 9 is manufactured by the following process.

Figure 8:
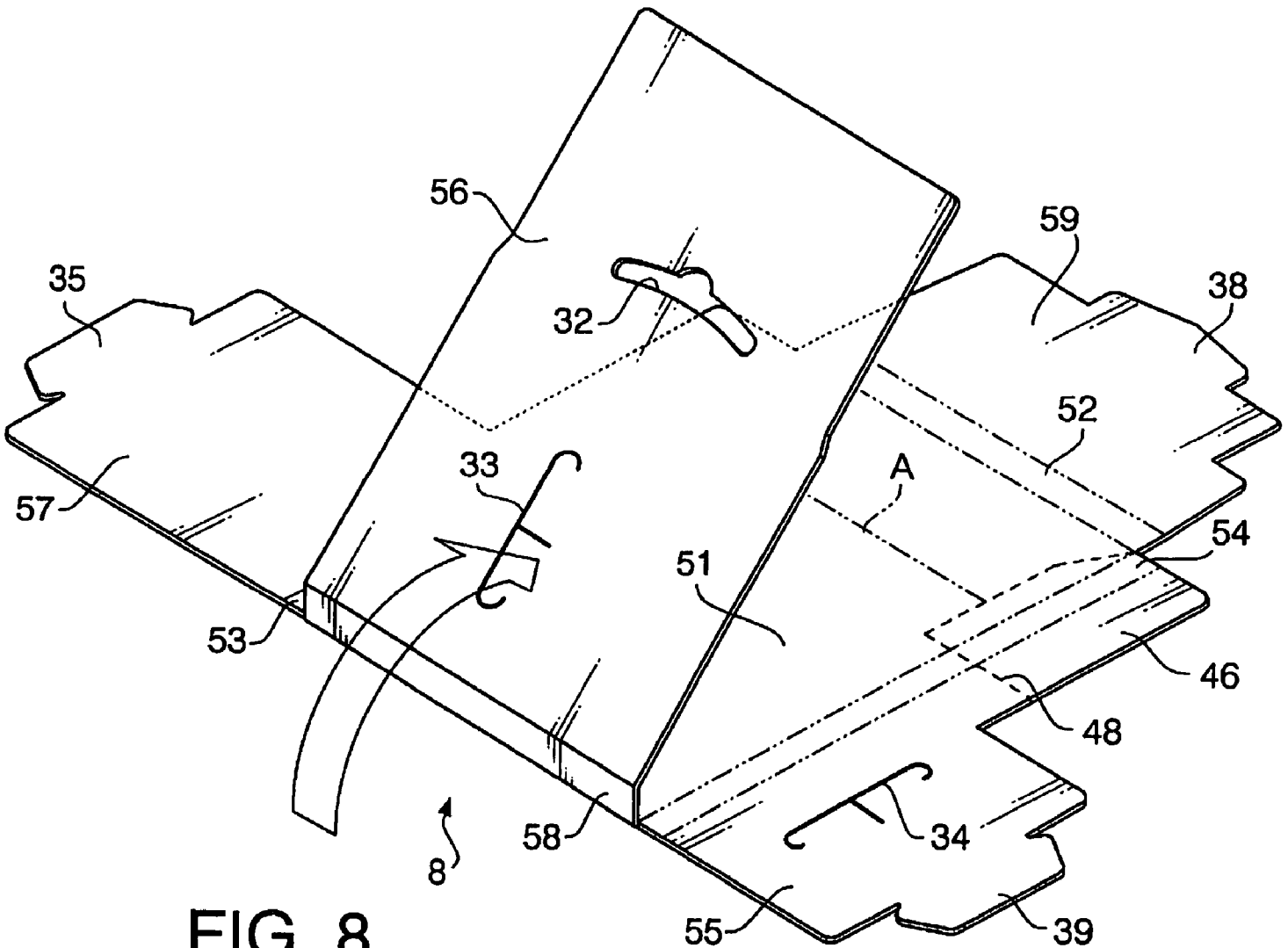
FIGS. 8 through 12 show a manufacturing process of the sheet package of FIG. 6.

First, as shown in FIG. 8, the end part 58 of the cardboard material is folded perpendicularly to the base 51 while the tongue part 56 is folded perpendicularly to the end part 58, by which the tongue part 56 is placed above and in parallel with the base 51, with a proper interval (corresponding to the length of the end part 58) from the base 51.

Figure 9:
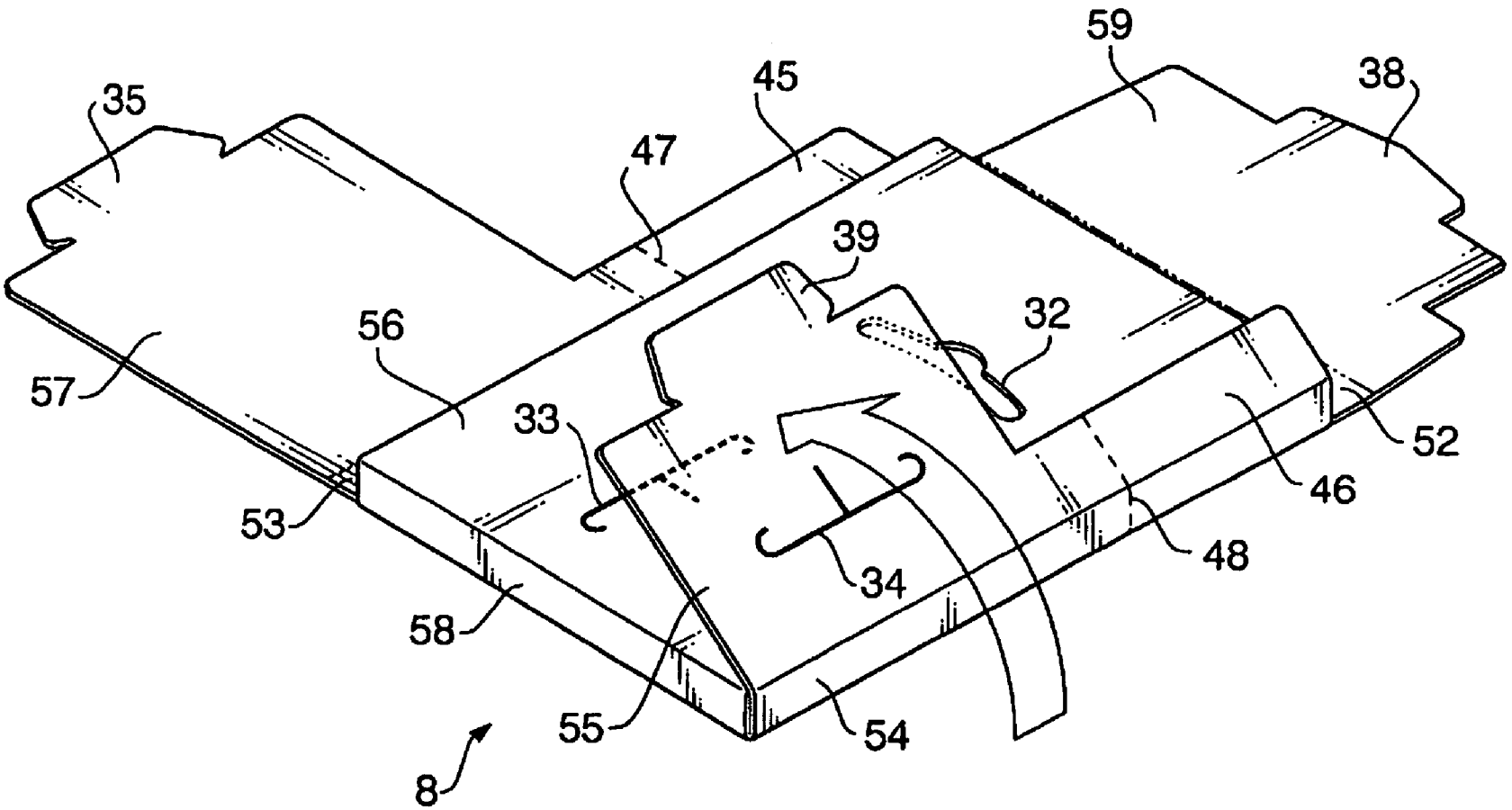

Subsequently, as shown in FIG. 9, the side part 54 is folded perpendicularly to the base 51 while the tongue fixing part 55 is folded perpendicularly to the side part 54, by which the tongue fixing part 55 is overlaid on the tongue part 56. Then, an insert 39 formed at the tip of the tongue fixing part 55 is inserted into the tongue fixing cut 33 of the tongue part 56.

Figure 10:
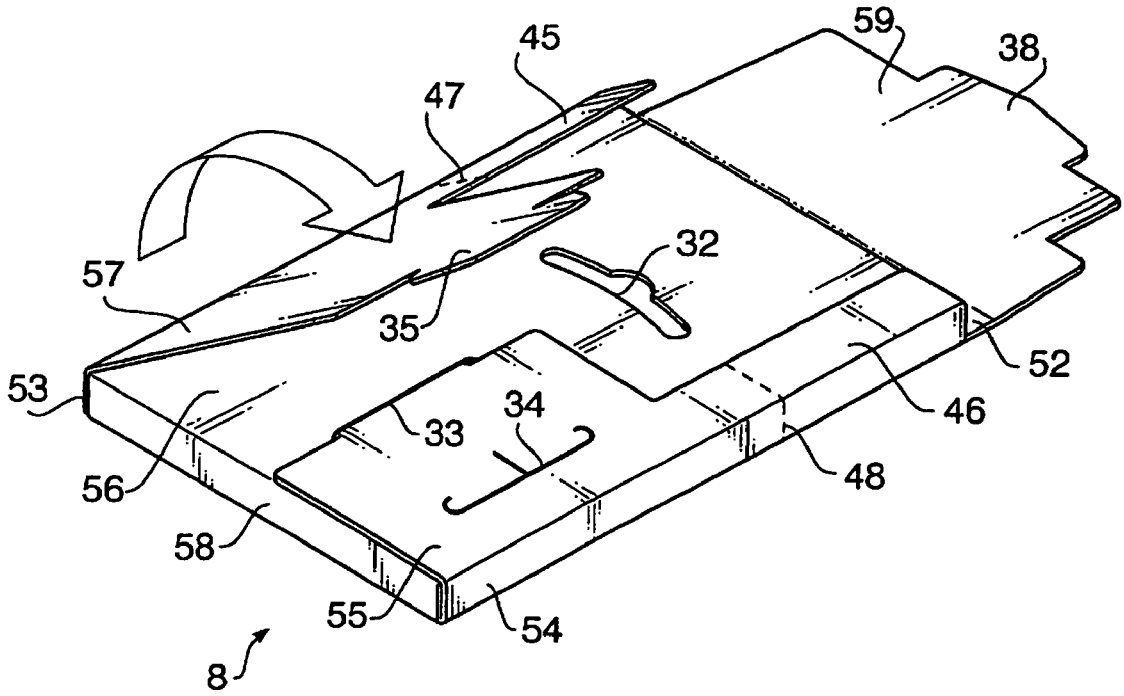

Subsequently, as shown in FIG. 10, the side part 53 is folded perpendicularly to the base 51 while the wrapping part 57 is folded perpendicularly to the side part 53, by which the wrapping part 57 is overlaid on the tongue part 56 and the tongue fixing part 55. Then, an insert 35 formed at the tip of the wrapping part 57 is inserted into the wrap fixing cut 34 of the tongue fixing part 55.

Figure 11:
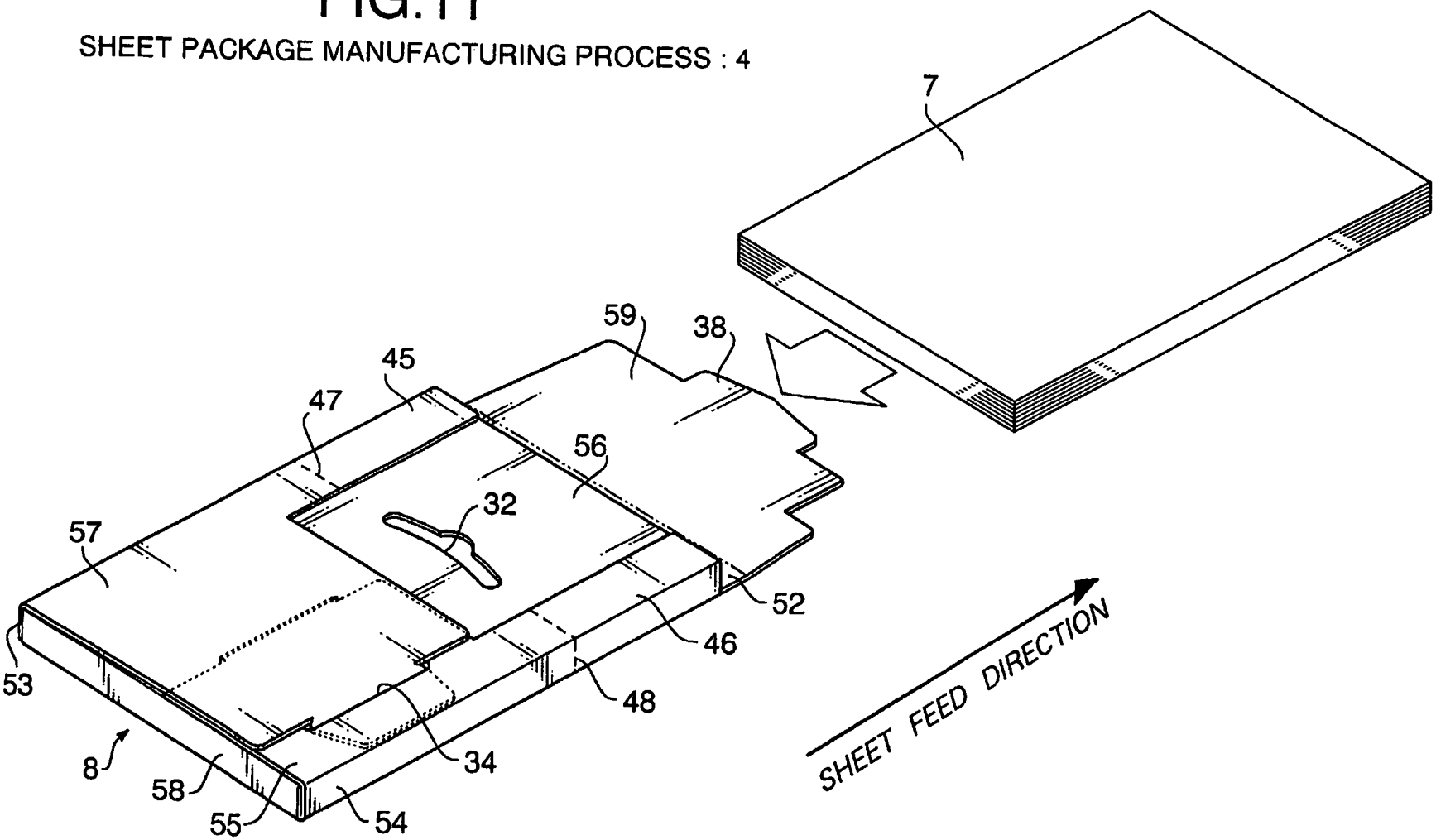

By the above process, the package member 8 is formed into a box in the shape of a rectangular parallelepiped as shown in FIG. 11. The box is open only at one end in its lengthwise direction (front end in the sheet feed direction). Other faces of the box are covered with the base 51, the tongue part 56, the side parts 53 and 54, and the end part 58.

Subsequently, the sheets 7 stacked up are inserted into the box through the open end between the base 51 and the tongue part 56. The stacked sheets 7 are inserted so that their heat-sensitive surfaces (print surfaces) will face the base 51. By this, the heat-sensitive surface of each sheet 7 faces the thermal head 15 when the sheet package 9 is loaded in the printer 1 and the sheet 7 is fed to the print mechanism 14 of the printer 1.

Figure 12:
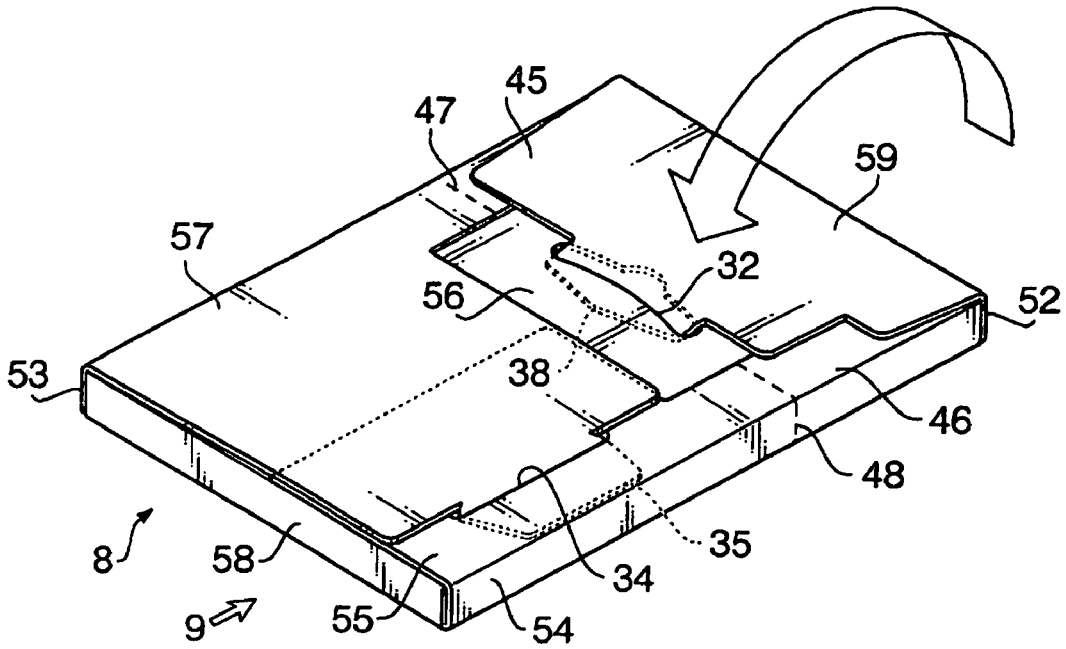

Subsequently, as shown in FIG. 12, the top part 52 is folded perpendicularly to the base 51 while the flap part 59 is folded perpendicularly to the top part 52, by which the flap part 59 is overlaid on the tongue part 56 and the open end of the box is closed with the top part 52. Then, an insert 38 formed at the tip of the flap part 59 is inserted into the flap fixing cut 32 of the tongue part 56, by which the flap part 59 is fixed to the tongue part 56.

By the above process, the sheet package 9 shown in FIG. 6 is completed. The above manufacturing process is carried out by the maker of the sheet package 9. The user of the printer 1 purchases the sheet package 9 in the state shown in FIG. 6 and sets the sheet package 9 in the printer 1 by the following procedure.

[Procedure for Setting Sheet Package in Printer]

Next, the procedure for setting the sheet package 9 (in the state of FIG. 6) in the printer 1 are shown in FIGS. 13 through 17.

Figure 13:
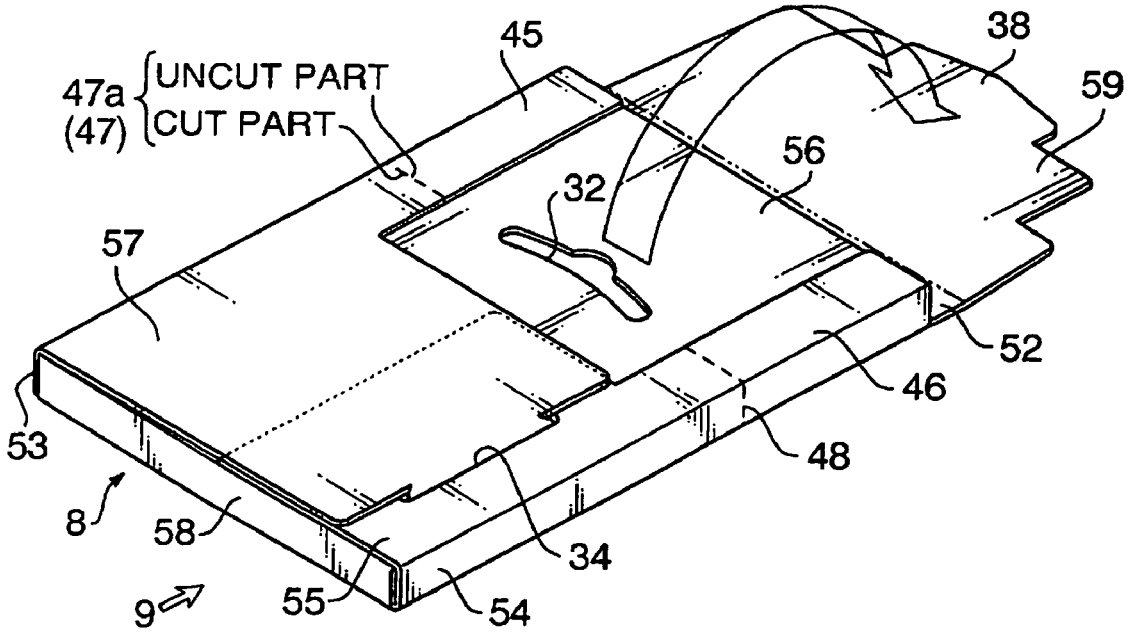
FIG. 13 through 17 show a procedure for setting the sheet package of FIG. 6 in the printer.

First, the insert 38 of the flap part 59 is pulled out from the flap fixing cut 32 and the flap part 59 is opened as shown in FIG. 13.

Figure 14:
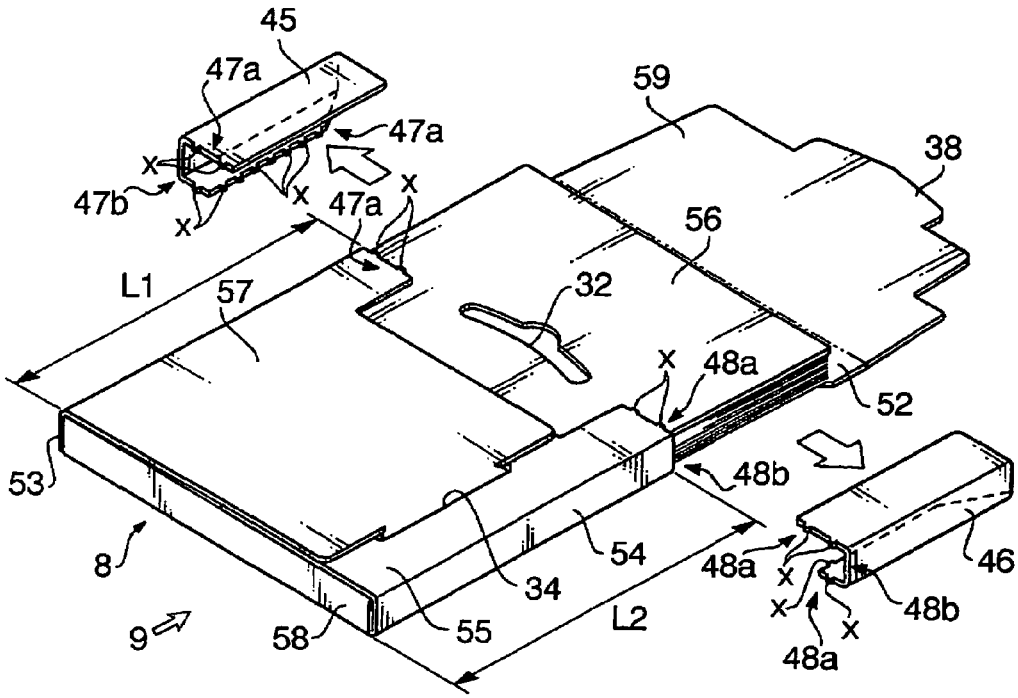

Subsequently, tear-off parts 45 and 46 formed on both sides of the package member 8 are cut away by fingers, for example as shown in FIG. 14.

The two tear-off parts 45 and 46 before being cut away (i.e. before the sheet package 9 is opened) cover side face parts of the sheets 7 inside and thereby protect the sheets 7 as parts of the package member 8.

When the sheet package 9 is opened and set in the printer 1, an area of the lowermost sheet 7 (facing the base 51) at the front end in the sheet feed direction (an area to make contact with the pickup roller 12 for sheet feeding) has to be exposed. By cutting the tear-off parts 45 and 46 away, the base 51 can be folded back at a crease line A shown in FIG. 7 and thereby the sheet 7 can be exposed as above.

As shown in FIG. 14, the tear-off part 45 (on the wrapping part 57 side) is formed in the front (in the sheet feed direction) of one side (lateral part) of the package member 8. The tear-off part 45 is formed to lie astride the wrapping part 57, the side part 53 and the base 51 as shown in FIG. 7.

For facilitating the removal of the tear-off part 45, the package member 8 is provided with a tear-off line 47 along the outline of the tear-off part 45. The tear-off line 47 includes perforated lines 47*a* and a cut 47*b*. Each perforated line 47*a* includes cut parts and uncut parts arranged alternately (see FIG. 13). Meanwhile, the cut 47*b* includes no uncut part.

The cut 47*b*, including no uncut part, is formed across the whole width of the side part 53 in a sheet stacking direction (to cross the side part 53 in the sheet stacking direction). Remaining parts of the tear-off line 47 (in the base 51 and the wrapping part 57) are the perforated lines 47*a*. The cut 47*b* connects with the perforated lines 47*a* at its both ends.

Since the perforated lines 47*a* include the uncut parts, cutting the tear-off part 45 away leaves burrs x along the perforated line 47*a* in the base 51 and/or along the perforated line 47*a* in the wrapping part 57 (see FIG. 14). However, no burr x occurs in the side part 53 (having the cut 47*b* including no uncut part). Even in extreme cases where the user tears the tear-off part 45 away by main force, no burr x remains on the cut edge in the side part 53. Consequently, the cut edge of the side part 53 made by the removal of the tear-off part 45 (cut edge corresponding to the cut 47*b*) keeps clean without burrs.

As shown in FIG. 14, the tear-off part 46 (on the tongue fixing part 55 side) is formed in the front (in the sheet feed direction) of the other side (lateral part) of the package member 8. The tear-off part 46 is formed to lie astride the tongue fixing part 55, the side part 54 and the base 51 as shown in FIG. 7.

Similarly to the tear-off line 47 of the tear-off part 45, a tear-off line 48 for facilitating the removal of the tear-off part 46 is formed along the outline of the tear-off part 46. The tear-off line 48 also includes perforations 48*a* and a cut 48*b*. The perforations 48*a* include cut parts and uncut parts arranged alternately, while the cut 48*b* includes no uncut part.

The cut 48*b*, including no uncut part, is formed across the whole width of the side part 54 in the sheet stacking direction. Remaining parts of the tear-off line 48 (in the base 51 and the tongue fixing part 55) are the perforations 48*a*. The cut 48*b* connects with the perforations 48*a* at its both ends.

Since the perforations 48*a* include the uncut parts, cutting the tear-off part 46 away leaves burrs x along the perforations 48*a* in the base 51 and/or the tongue fixing part 55 (see FIG. 14). However, no burr x occurs in the side part 54 (having the cut 48*b* including no uncut part). Even in extreme cases where the user tears the tear-off part 46 away by main force, no burr x remains on the cut edge in the side part 54. Consequently, the cut edge of the side part 54 made by the removal of the tear-off part 46 (cut edge corresponding to the cut 48*b*) keeps clean without burrs.

Incidentally, the tear-off line 47 shown in FIG. 7 can also be interpreted as a single perforated line formed along the outline of the tear-off part 45 so as not to leave the aforementioned uncut parts in the side part 53. Similar interpretation holds for the other tear-off line 48.

Figure 15:
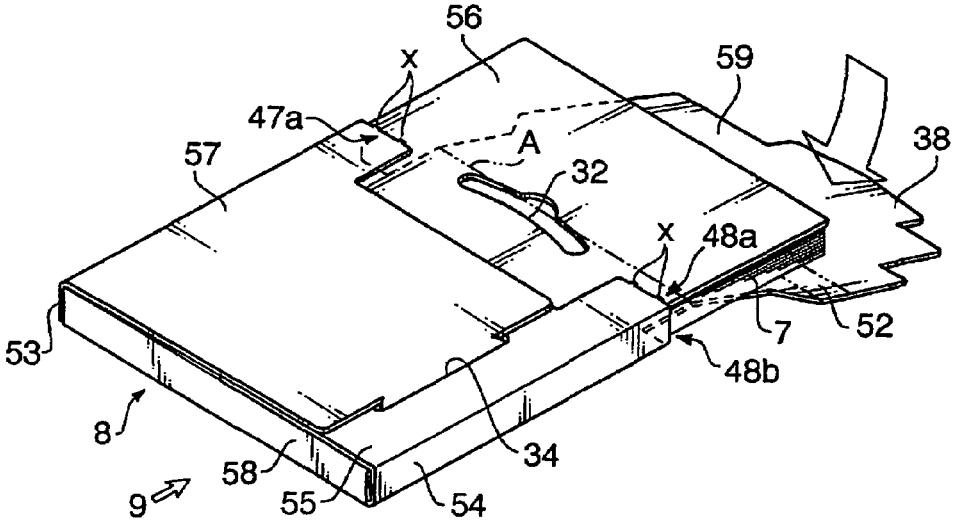

By removing the tear-off parts 45 and 46, the front part of the base 51 in the sheet feed direction can be folded downward (outward) at the crease line A together with the flap part 59 and the top part 52 (FIG. 15). Further, the insert 38 formed at the tip of the flap part 59 which has been folded back can be inserted into the setting cut 31 of the base 51 (FIGS. 16A and 16B), by which the flap part 59, the top part 52 and the part of the base 51 folded back from the crease line A are fixed to the exterior surface of the base 51 and part of the sheets 7 is exposed from the package member 8.

Figure 16A:
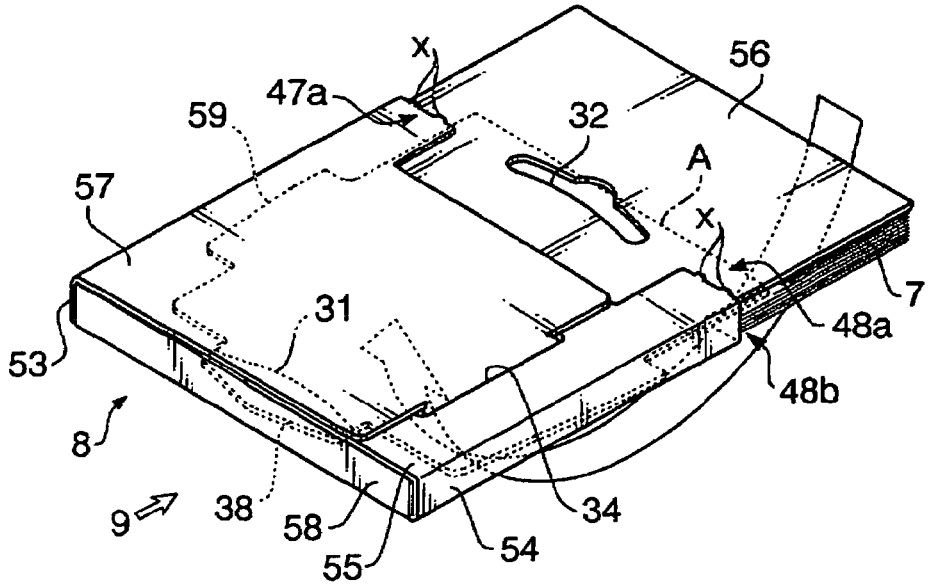
Figure 16B:
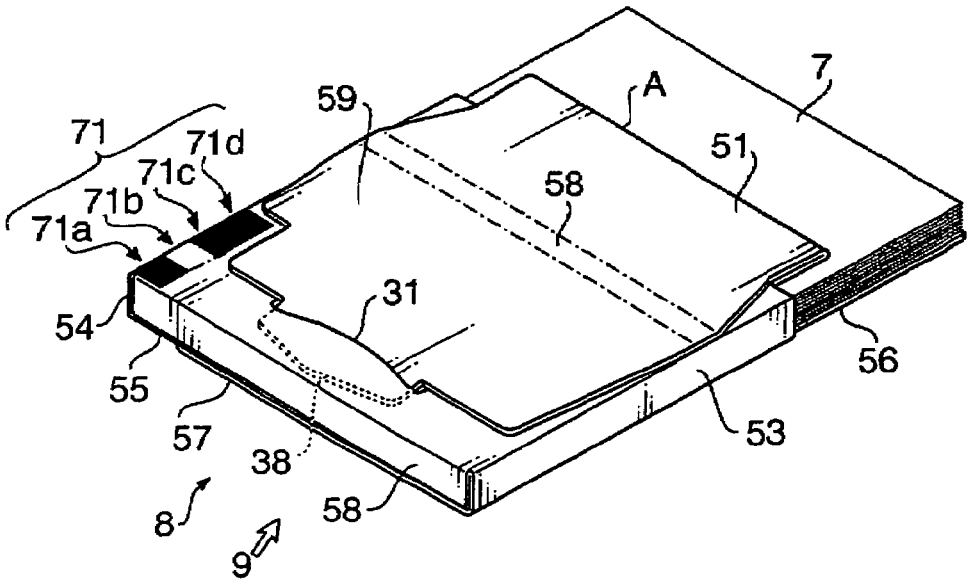

FIG. 16B is a perspective view of the sheet package 9 put upside down with the flap part 59 opened. The flap part 59 is formed so that it will not overlap with the identification mark 71 when the insert 38 is put into the setting cut 31.

The identification mark 71 includes four rectangular indicator bits 71*a*-71*d* arranged in a line. Among the four bits, 0-3 bits are colored black, while the other bits are not colored, retaining the color (white) of the foundation of the package member 8. In the example of FIG. 16B, the indicator bits 71*a*, 71*c* and 71*d* are colored black, while the remaining bit 71*b* is left white. The indicator bits can be colored by well-known methods such as printing.

The above black/white pattern represents the type of the sheets 7 (heat-sensitive paper of a normal type, heat-sensitive paper capable of gaining two colors, label paper, duplicate paper, etc.) stored in the package member 8.

Figure 17:
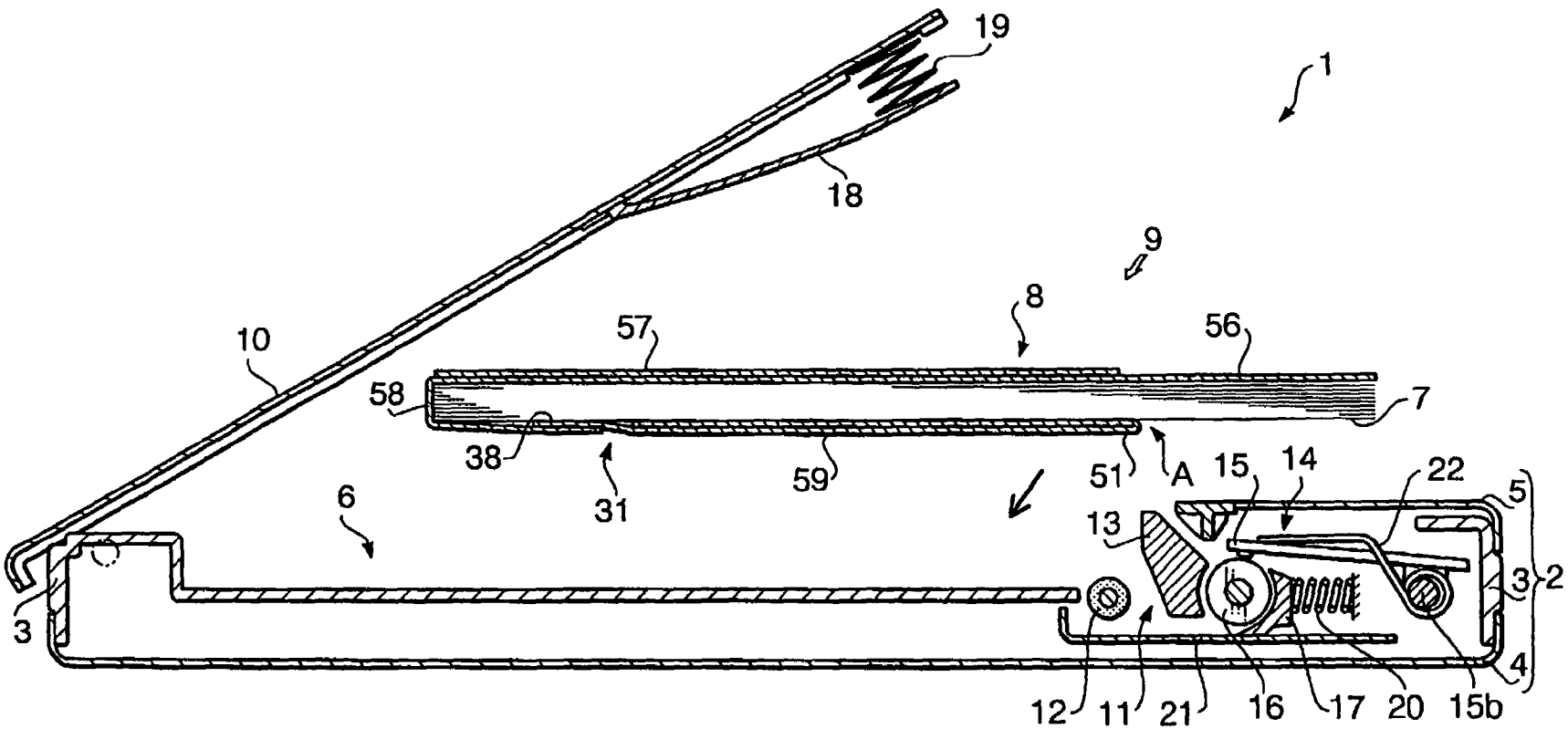

Subsequently, as shown in FIG. 17, the sheet package 9 is set in the sheet storage unit 6 of the printer 1 with the base 51 facing downward, by which the part of the lowermost sheet 7 (lowermost one of the sheets 7 stacked up in the package member 8) exposed from the package member 8 makes contact with the top of the pickup roller 12. Thus, by driving and rotating the pickup roller 12, the sheet 7 can be fed to the print mechanism 14.

Figure 18:
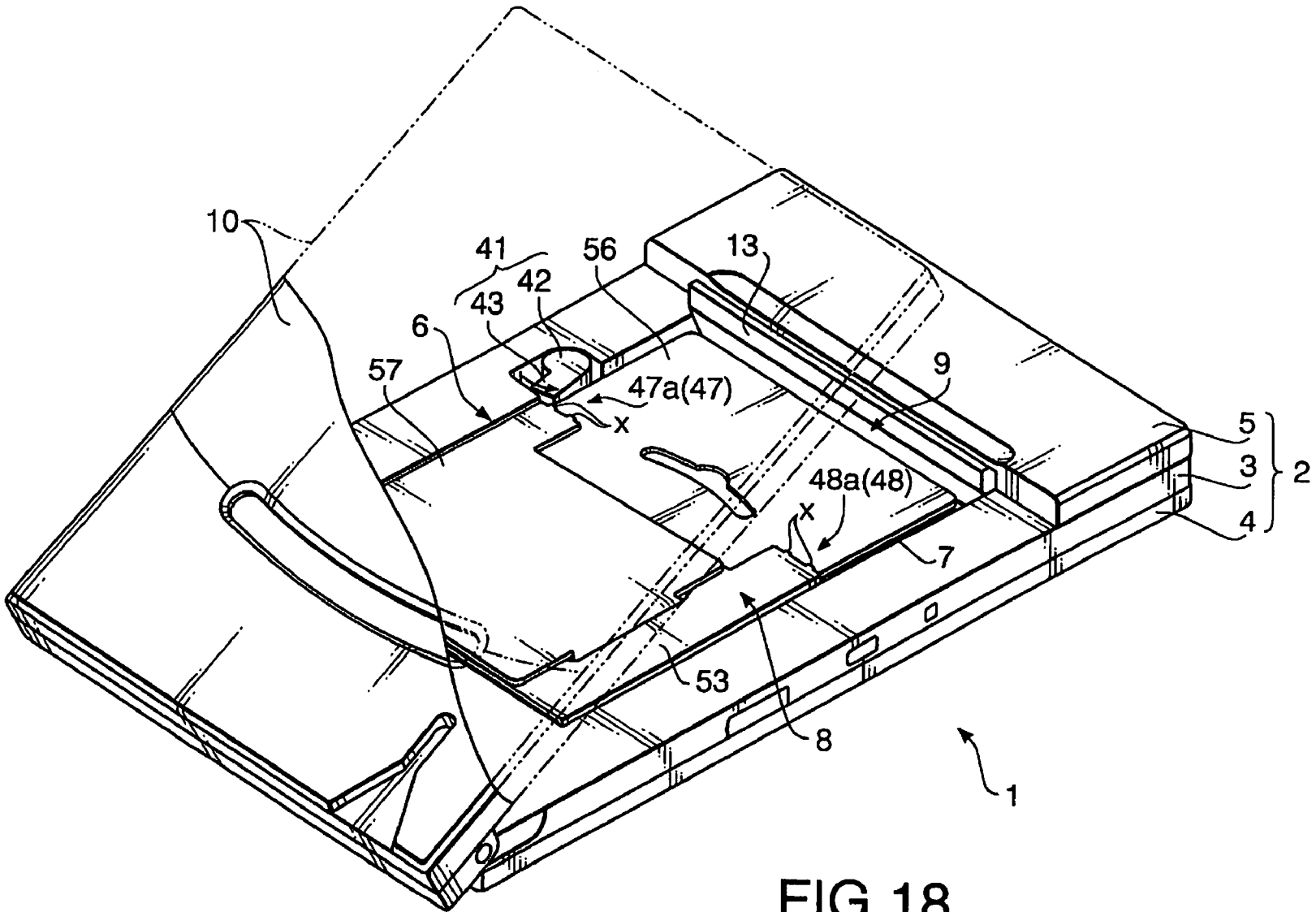
FIG. 18 is a perspective view of the printer with the sheet package stored in a sheet storage unit.

FIG. 18 is a perspective view of the printer 1 with the sheet package 9 completely stored in the sheet storage unit 6. With the sheet package 9 stored in the sheet storage unit 6, the guide member 41 of the sheet storage unit 6 rotates in the direction of the arrow shown in FIG. 18 so as to let the arm 43 push the side face of the sheets 7.

Figure 19:
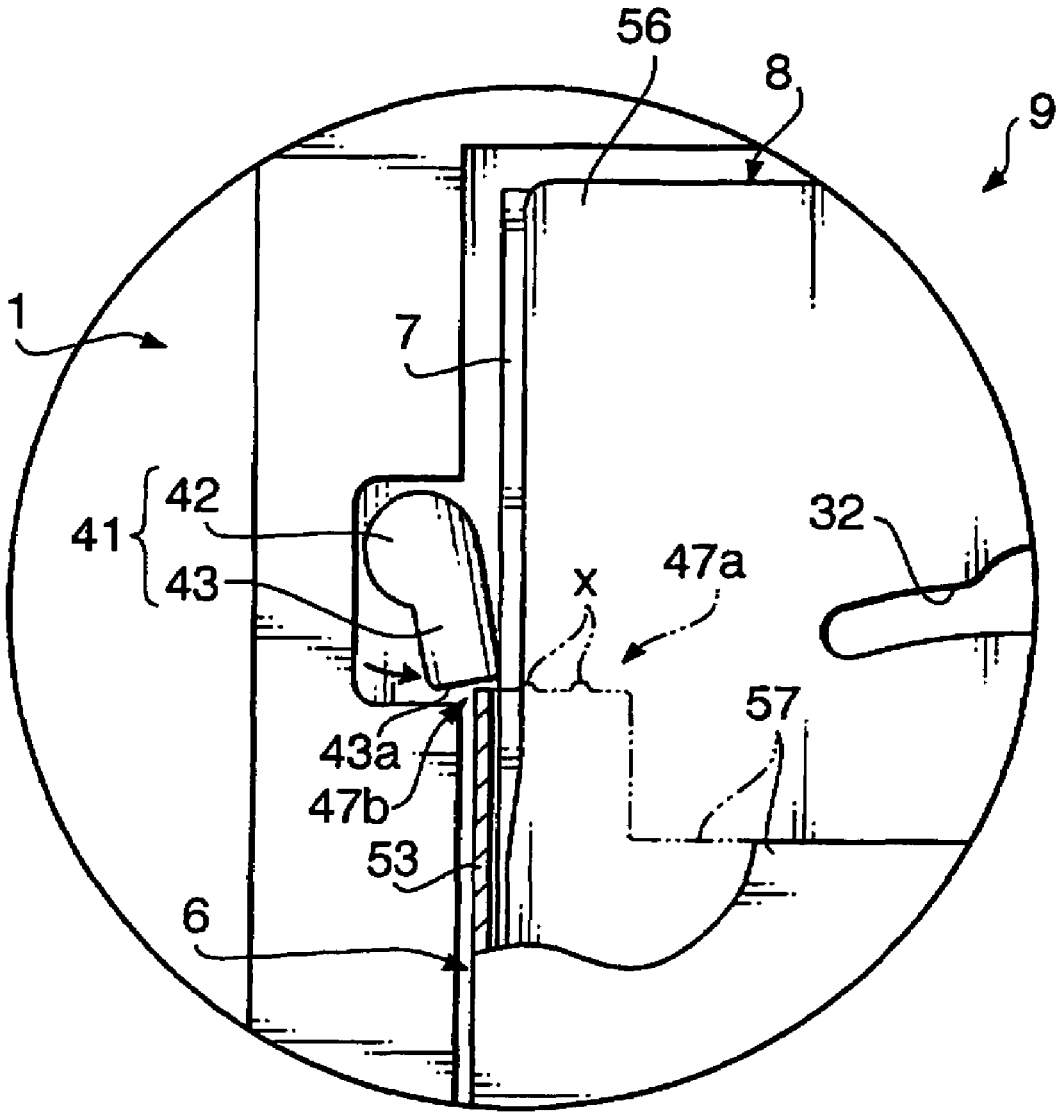
FIG. 19 is an enlarged view of a part of the printer in the vicinity of a guide member.

FIG. 19 is an enlarged view of a part of the printer 1 in the vicinity of the guide member 41, in which the arm 43 of the guide member 41 contacting and pushing the sheets 7 is shown. As shown in FIG. 19, the arm 43 pushes the side face of the sheets 7, at a position extremely close to the edge of the side part 53 of the package member 8. This is for enhancing the effect of the guide member 41 to align (even up) the edges of the sheets 7.

The guide member 41, being required to contact the side face of the sheets 7, has to be placed avoiding the side part 53 (in the part where the tear-off part 45 has been removed). However, to enhance the effect of aligning the sheets 7, it is desirable to place the guide member 41 to let it push a part of the side face of the sheets 7 as close as possible to the center of the side face in regard to the sheet feed direction.

Therefore, in cases where the side part 53 covers the side face of the sheets 7 by half or more as in this embodiment, it becomes necessary to place the guide member 41 extremely close to the edge of the side part 53 in order to let the guide member 41 effectively even up the edges of the sheets 7.

The edge of the side part 53 shown in FIG. 19 has been made by cutting the tear-off part 45 away from the tear-off line 47. Specifically, the edge of the side part 53 derives from the aforementioned cut 47*b* of the tear-off line 47 having no uncut part. Thus, the edge of the side part 53 is a clean and straight cut edge with no burr x, differently from cut edges deriving from the perforated lines 47*a* (cut edges of the base 51 and the wrapping part 57).

Therefore, even if the arm 43 is placed extremely close to the edge of the side part 53, the arm 43, being interfered with no burr x, can securely push the sheets 7. As above, the guide member 41 can effectively even up the edges of the sheets 7 and avoid the skewing (oblique sheet feed) when the sheet 7 is fed to the print mechanism 14.

In this embodiment, the cut 47*b* of the side part 53 is formed straight across the whole thickness of the package member 8 in the sheet stacking direction and thus no burr x occurs at the edge of the side part 53. Therefore, the guide member 41 can be formed in a simple shape with no need of giving a special shape to its arm 43 for avoiding the burrs x, by which the manufacturing cost can be reduced.

Incidentally, the guide member 41 protruding from the concave part 40 prevents the package member 8 from shifting forward in the sheet feed direction by making contact with the edge of the side part 53 of the package member 8 (the edge made by removing the tear-off part 45), by which the sheet package 9 is kept at an appropriate position in the sheet storage unit 6.

The package member 8 is designed so that the difference between the length L1 of the side part 53 in the sheet feed direction after the removal of the tear-off part 45 (see FIG. 14) and the distance from the tip of the guide member 41 (the tip 43*a* of the arm 43, see FIG. 19) to the rear wall 6*a* of the sheet storage unit 6 in the sheet feed direction (see FIG. 3) will be smaller than a maximum permissible displacement of the identification mark 71 for the reflective sensor unit 70. Therefore, when the edge of the side part 53 is in contact with the guide member 41, the sheet package 9 is placed at a position allowing the reflective sensor unit 70 to read the identification mark 71.

After the insertion of the sheet package 9 in the sheet storage unit 6 of the printer 1, the lid 10 is closed as shown in FIGS. 3 and 4. In this state, the tongue part 56 is situated between the pressure plate 18 (for pressing the sheets 7 against the pickup roller 12) and the sheets 7.

As above, the sheets 7 are set in the printer 1 in the form of the sheet package 9. When all the sheets 7 of the sheet package 9 have been printed on, the remaining package member 8 is pulled out from the printer 1 and discarded.

The sheet package 9 configured as above has the advantage of preventing deterioration of the sheet separation function of the pickup roller 12 and the separation block 13 even if a large number of sheets 7 are printed on by the printer 1. If the stack of sheets 7 is in direct contact with the pressure plate 18 not via the tongue part 56, the pressure plate 18 wears off due to the continuing use of the printer 1 and thereby friction between the pressure plate 18 and the stack of sheets 7 decreases. Consequently, the pressure plate 18 becomes incapable of separating the stack of sheets 7 from the lowermost sheet 7 being fed by the pickup roller 12, by which a plurality of sheets 7 are fed to the print mechanism 14 at once. Meanwhile, in the sheet package 9 of this embodiment, the stack of sheets 7 in contact with the tongue part 56 does not directly contact the pressure plate 18. The package member 8 is replaced with new one every time when the sheets 7 inside the package member 8 are used up, therefore, friction between the tongue part 56 and the stack of sheets 7 does not drop due to the long-term use. Consequently, the tongue part 56 remains capable of excellently separating the stack of sheets 7 from the lowermost sheet 7 being fed by the pickup roller 12, by which the multifeed (a plurality of sheets 7 fed to the print mechanism 14 at once) is prevented.

[Procedure for Replacing Sheet Package]

The printer 1 is capable of printing on not only heat-sensitive sheets but also various types of sheets (a duplicate sheet having two sheets bonded to each other allowing simultaneous printing on the two sheets, a label sheet having a heat-sensitive sheet and a separator bonded together via an adhesive layer so that the heat-sensitive sheet peeled off from the separator after the printing can be stuck on something, etc.) according to the intended use. Therefore, there are cases where the user hopes to print on a sheet of a different type before using up all the sheets 7 stored in the current sheet package 9. In such cases, the sheet package 9 set in the printer 1 has to be replaced since one sheet package 9 stores sheets 7 of only one type.

Figure 20:
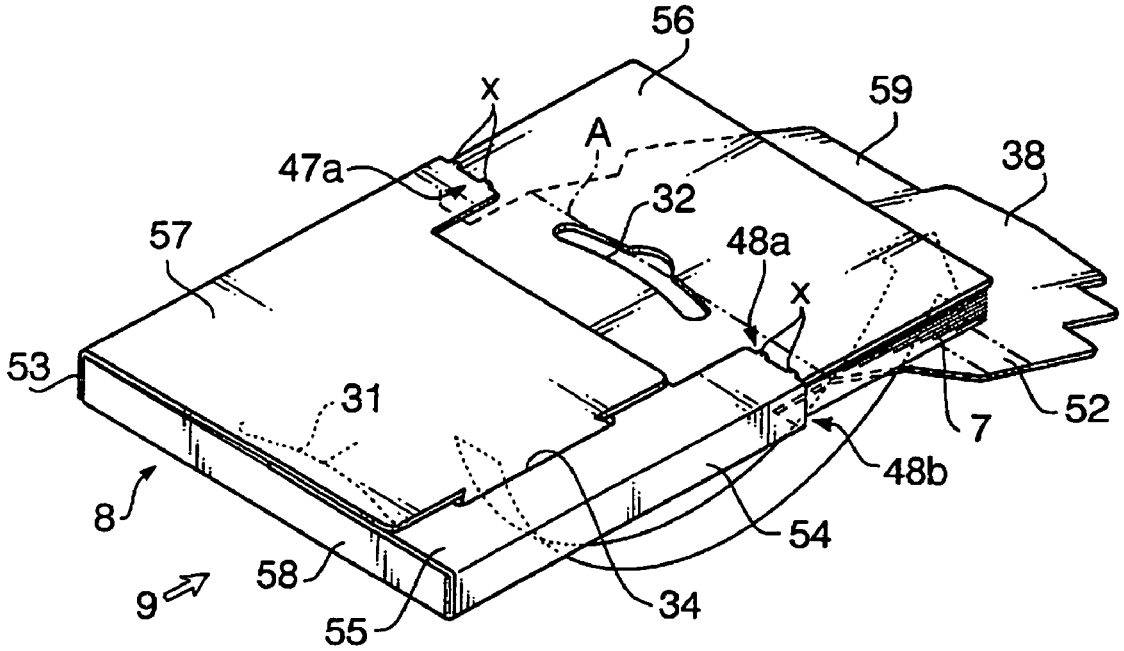
FIGS. 20 and 21 show a method for closing the sheet package.

To replace the sheet package 9, the lid 10 of the printer 1 is opened and the sheet package 9 is pulled out from the sheet storage unit 6. Subsequently, the insert 38 at the tip of the flap part 59 is pulled out from the setting cut 31 as shown in FIG. 20 and the flap part 59 which has been folded back from the crease line A is returned upward as indicated by the arrows in FIGS. 20 and 21. Thereafter, the insert 38 is put into the flap fixing cut 32, by which the flap part 59 is fixed to the package member 8, closing the open side of the package member 8 as shown in FIG. 21.

Figure 21:
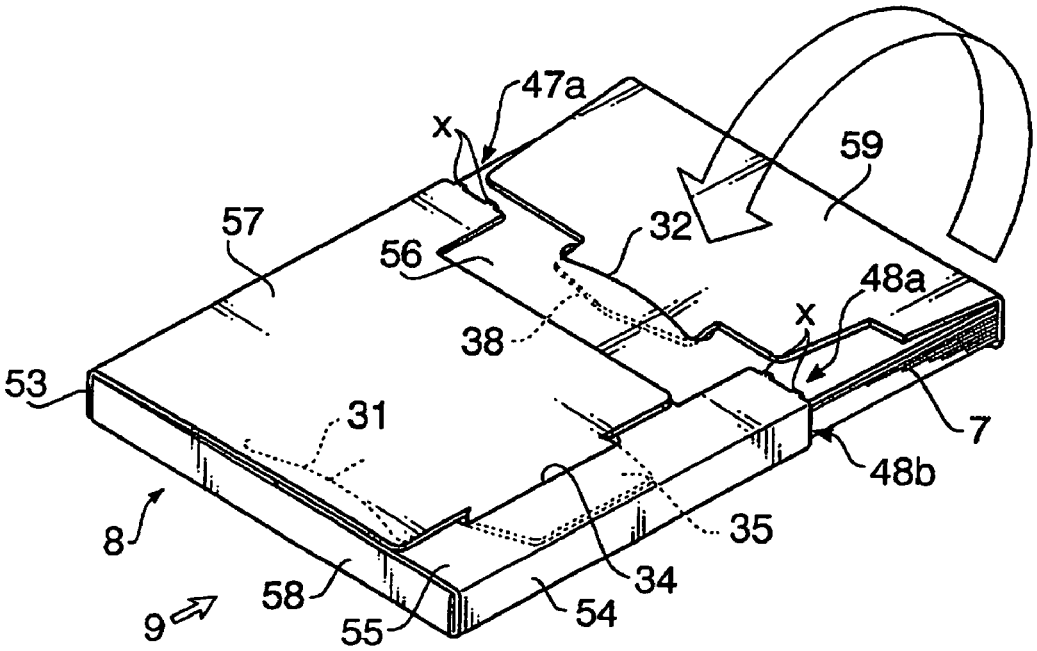

The sheet package 9 is reserved in the state shown in FIG. 21. To reuse the sheet package 9, the insert 38 of the flap part 59 is pulled out from the flap fixing cut 32 and the flap part 59 is folded back downward from the crease line A. Subsequently, the insert 38 is put into the setting cut 31 and the sheet package 9 is set in the printer 1.

[Composition of Tear-Off Line]

The two perforated lines 47*a* and 48*a* in the base 51 are formed so as to connect with ends of a boundary line B between the base 51 and the top part 52 without overlapping with the boundary line B. Specifically, the perforated lines 47*a* and 48*a* first run in the sheet feed direction, bend gently to separate from each other, and connect with the ends of the boundary line B respectively. By configuring the perforated lines 47*a* and 48*a* as above, the package member 8 can be prevented from being torn apart at the boundary line B when the tear-off part 45 is cut away from the tear-off line 47.

If the perforated lines 47*a* and 48*a* have parts overlapping with the boundary line B (see FIG. 7), the boundary line B which has already been weakened by the creasing process is further weakened by the separation of the tear-off parts 45 and 46, by which the package member 8 tends to be torn apart at the boundary line B more easily.

In this embodiment, the tear-off parts 45 and 46 are supposed to be cut away by the user. The user might violently rip off the tear-off parts 45 and 46 by force, by which the package member 8 might get torn apart, from a part where the boundary line B intersects with a perforated line. If the package member 8 is torn apart at the boundary line B, it becomes impossible to close the flap part 59 again as shown in FIGS. 20 and 21 when the sheet package 9 during use is pulled out from the printer. However, such problems are eliminated in this embodiment since the tear-off parts 45 and 46 are configured as described above to prevent the package member 8 from being torn apart accidentally.

[Composition of Insert of Tongue Fixing Part and Tongue Fixing Cut]

Next, the composition of the tongue fixing cut 33 and the insert 39 to be inserted in the tongue fixing cut 33 will be explained.

Figure 22A:
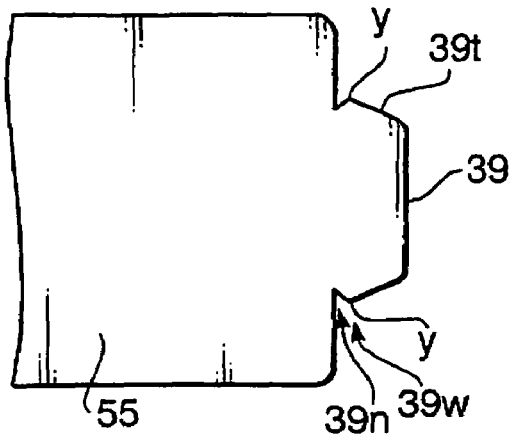
FIG. 22A is a plan view showing a part of a tongue fixing part.

FIG. 22A is a plan view showing a part of the tongue fixing part 55 including the insert 39. As shown in FIG. 22A, the insert 39 is formed at the tip of the tongue fixing part 55. The insert 39 is provided with a pair of projections y protruding from its both sides. By the formation of the projections y, a wide part 39*w* is formed in the insert 39.

Meanwhile, a basal part of the insert 39 is a narrow part 39*n* which is narrower than the wide part 39*w*. A distal part of the insert 39 across the wide part 39*w* is formed with a taper 35*t*. The taper 35*t* facilitates the insertion of the insert 39 into the tongue fixing cut 33.

Figure 22B:
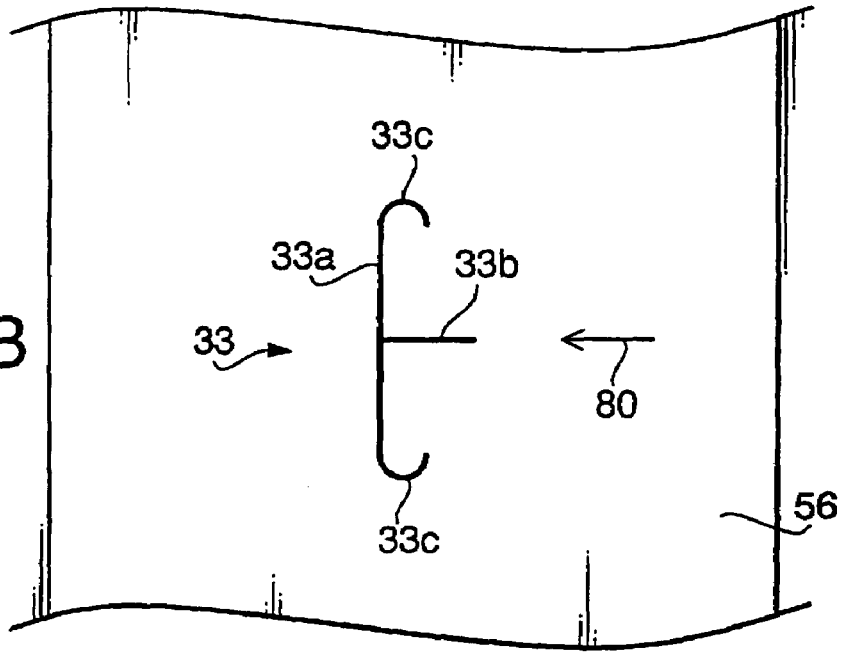
FIG. 22B is a plan view showing a part of the tongue part.

FIG. 22B is a plan view showing a part of the tongue part 56. As shown in FIG. 22B, the tongue part 56 is provided with the tongue fixing cut 33. The tongue fixing cut 33 includes a first cut 33*a* and a second cut 33*b*. The first cut is formed to be substantially orthogonal to the direction of insertion of the insert 39 into the tongue fixing cut 33 (the direction indicated by the arrow 80). The second cut 33*b* is formed to extend from the approximate center of the first cut 33*a* in a direction substantially orthogonal to the first cut 33*a*.

The insert 39 is let into the first cut 33*a* by sliding it on the tongue part 56 along the second cut 33*b*. The second cut 33*b* lowers the stiffness of the tongue part 56. Therefore, by slightly pressing the insert 39 against the tongue part 56 while sliding the insert 39 thereon, part of the tongue part 56 around the second cut 33*b* is dented, opening the first cut 33*a* and facilitating the insertion of the insert 39.

Each end part 33*c* of the first cut 33*a* curves in a direction opposite to the direction of insertion of the insert 39 (opposite to the arrow 80) in the shape of the letter "U". In other words, both ends 33*c* of the first cut 33*a* are curved as if to return to the center of the first cut 33*a*. Therefore, the end parts 33*c* do not get torn easily even if a side edge of the insert 39 comes in contact.

Figure 22C:
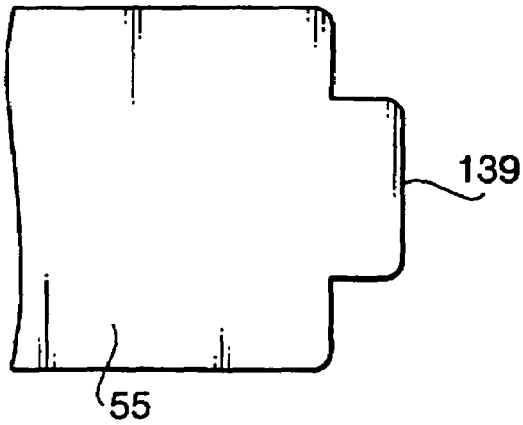
FIG. 22C shows a modification of an insert shown in FIG. 22A.

FIG. 22C shows a modification of the insert 39 which has been shown in FIG. 22A. The insert 139 shown in FIG. 22C is configured similarly to the insert 39 of FIG. 22A except that the width of the insert 139 is kept substantially the same along the direction of insertion. The width of the insert 139 is substantially equal to or slightly smaller than the maximum width of the first cut 33*a* measured in the direction orthogonal to the direction of insertion of the insert 139.

In the package member 8 of this embodiment, when the insert 39 (or the insert 139) is put into the tongue fixing cut 33, the tongue part 56 is fixed to the base 51 along the sheet feed direction, with the corner between the tongue part 56 and the end part 58 and the corner between the base 51 and the end part 58 angled at approximately right angles as shown in FIG. 17, for example.

Figure 23A:
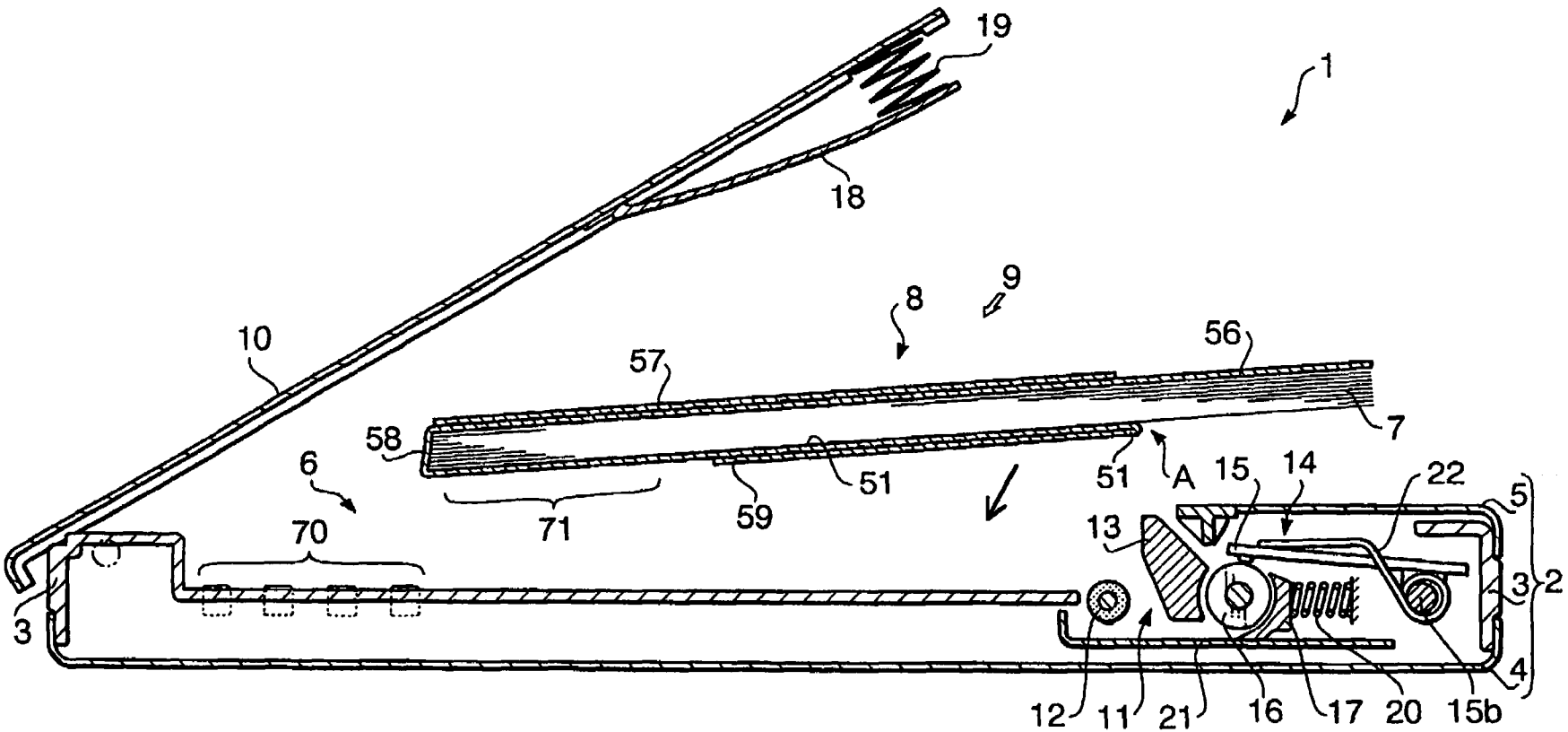
FIGS. 23A and 23B are cross-sectional views showing the printer and the sheet package with its tongue part shifted relative to its base.
Figure 23B:
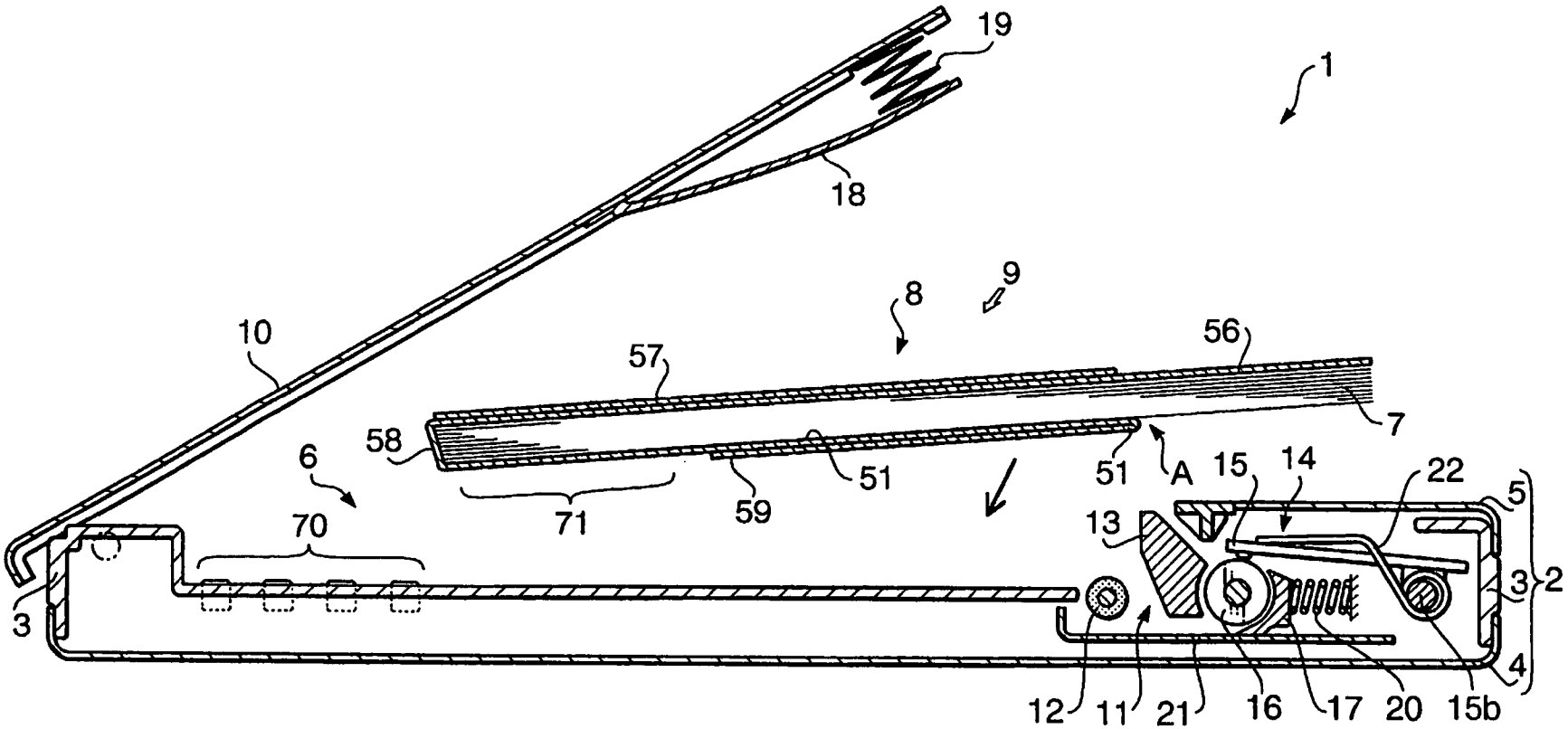

On the other hand, if the package member 8 is not provided with the insert 39 (or the insert 139) and the tongue fixing cut 33, the tongue part 56 can shift relative to the base 51 in the sheet feed direction as shown in FIGS. 23A and 23B. In such cases, the sheet package 9, with the end part 58 leaning with respect to the tongue part 56 and the base 51, can not be inserted in the sheet storage unit 6 of the printer 1 easily. The sheet package 9 of this embodiment, reducing such problems, can be set in the sheet storage unit 6 smoothly.

While an embodiment in accordance with the present invention has been described above, the scope of the present invention is not to be restricted by the above particular illustrative embodiment. It is to be appreciated that a variety of modifications are possible without departing from the scope and spirit of the present invention.

For example, the information indicated by the identification mark 71 is not limited to the type of the sheet 7 but can be any kind of information that can be read by a sensor provided to the printer. The identification mark 71 can also be implemented as, for example, a pattern made of one or more holes formed at prescribed positions on the sheet package 9, instead of the printed black/white pattern made of rectangular bits. The sensor of the printer is not limited to the reflective sensor unit 70; any contact or non-contact sensor can be used.

While the cut (47*b*, 48*b*) is formed in not only the side part 53 but also the side part 54 of the package member 8 in the above embodiment, in cases where the sheet storage unit 6 has only one guide member 41 on one of its side walls, the skewing of the sheet 7 can be prevented by forming a cut (47*b*) in a side part (53) facing the guide member 41. Therefore, the other side part 54 may be provided with a perforated line instead of the cut 47*b*.

Figure 24:
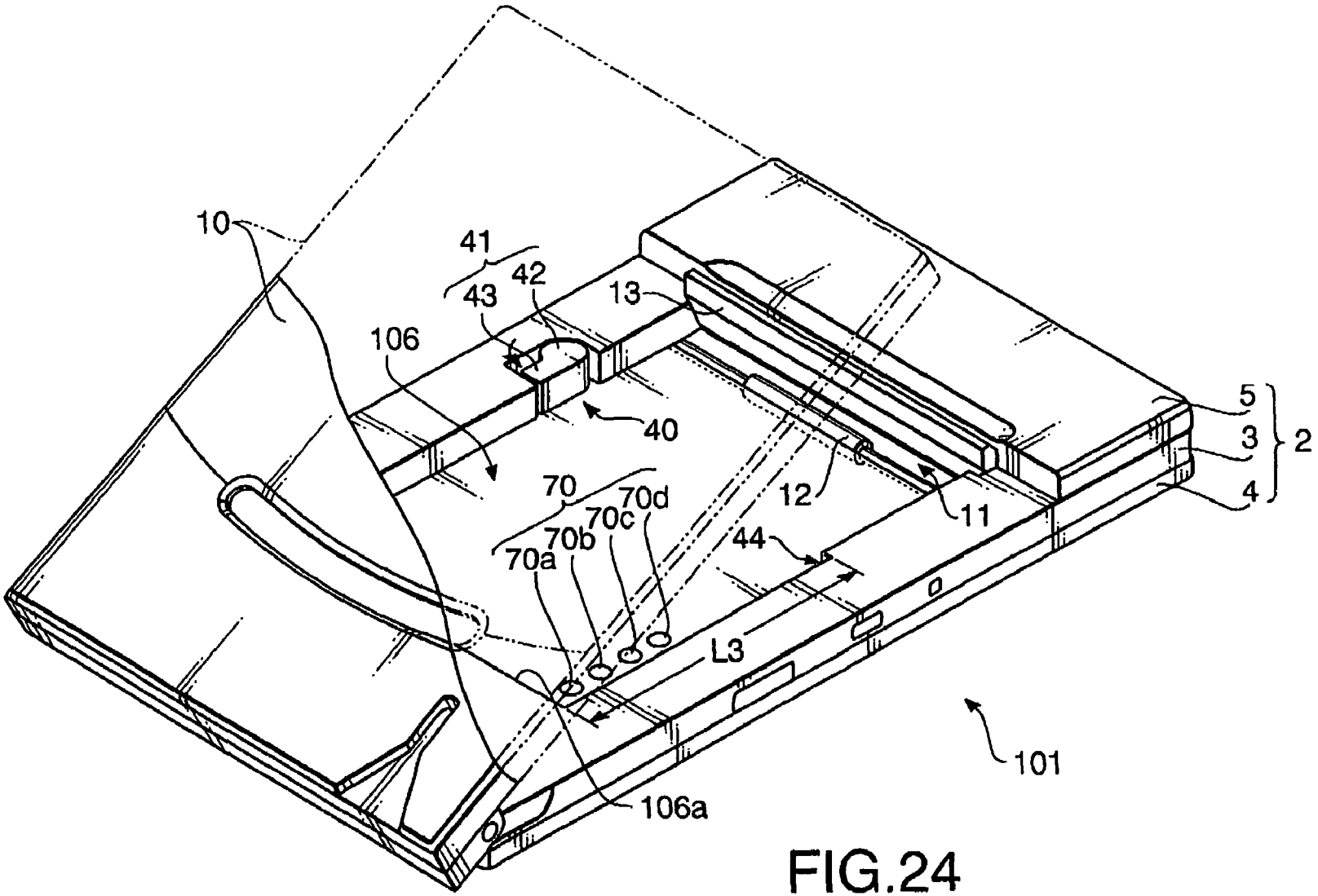
FIG. 24 is a perspective view showing a modification of the printer shown in FIG. 1.

The sheet package 9 of the above embodiment has the cut (47*b*) also in the side part 54 since the sheet package 9 is designed to be usable also for a printer (101) having a sheet storage unit like the one (106) shown in FIG. 24. The printer 101 has substantially the same configuration as the printer 1 of FIG. 1 except for a step part (level difference) 44 formed on a side wall of the sheet storage unit 106 corresponding to the side part 54 of the package member 8.

The step part 44 is formed in a part of the side wall of the sheet storage unit 106 corresponding to the tear-off part 46 of the package member 8. The height of the step part 44 (level difference) is substantially equal to the thickness of the package member 8. The step part 44 is formed so that a cut edge of the cut 48*b* (front edge of the side part 54 in the sheet feed direction) will make contact with the step part 44 when the sheet package 9 is inserted in the sheet storage unit 106. In other words, the step part 44 is placed so that the distance L3 from the step part 44 to the rear wall 106*a* of the sheet storage unit 106 in the sheet feed direction will be substantially equal to the length L2 of the side part 54 in the sheet feed direction after the removal of the tear-off part 46 (see FIG. 14).

The above step part 44 positions the sheet package 9 correctly in the sheet feed direction. Specifically, the step part 44 positions the sheet package 9 so that the reflective sensor unit 70 can read the identification mark 71. Therefore, the reflective sensor unit 70 can read the identification mark 71 correctly at all times. The cut edge of the cut 48*b* (front edge of the side part 54 in the sheet feed direction) serves as a positioning part for positioning the sheet package 9 correctly in the sheet feed direction by making contact with a part/member of the printer 1.

Since the cut edge of the cut 48*b* (the edge of the side part 54) is a clean cut edge with no burr x, the cut edge makes contact with the step part 44 leaving no gap when the sheet package 9 is set in the sheet storage unit 6. Therefore, the sheet package 9 is positioned in the sheet storage unit 6 precisely.

The cut 48*b* of the side part 54 is formed straight across the whole thickness of the side part 54 in the sheet stacking direction. This allows the step part 44 to be designed and formed as a simple and flat face.

As the positioning part or member, not only the step part 44 but also various configurations can be employed. For example, it is possible to provide a projection to the side wall of the sheet storage unit 6 instead of the step part 44 and let a spring push the projection rearward in the sheet feed direction.

What is claimed is:

1. A sheet package to be set in a sheet storage unit of a printer for supplying the printer with sheets, comprising:

a stack of sheets; and a package member covering the stack of sheets, wherein:

the sheets are supplied from the sheet package to the printer along a sheet feed direction, the package member has a side part, the side part including a portion that is attached to the package member at a first position and is separated from the package member at a second position, the side part being in parallel with the sheet feed direction and having a front edge and a rear edge relative to the sheet feed direction at the second position, the side part is structured such that the front edge contacts with a projecting part formed in the sheet storage unit in accordance with placement of the package member in the sheet storage unit relative to the sheet feed direction, and includes at least a first part and a second part, the sheet package includes a fold-back part to be folded back in order to expose part of the stack of sheets, the fold-back part is structured to be foldable by removing the one of the first part and the second part of the side part at a perforated line, the projecting part formed in the sheet storage unit is a pressing member which presses a side face of the stack of sheets so as to align the stack of sheets in a direction orthogonal to the sheet feed direction, and the pressing member is placed in a concave part formed on a side wall of the sheet storage unit corresponding to the side part, being pushed by a pushing member in the concave part so as to project from the concave part and press the side face of the stack of sheets.

* * * * *